US011627783B2

(12) United States Patent
Chen

(10) Patent No.: US 11,627,783 B2
(45) Date of Patent: Apr. 18, 2023

(54) LEVER-CONTROLLABLE MAGNETIC BUCKLE

(71) Applicant: BUTTON INTERNATIONAL CO., LTD., Taipei (TW)

(72) Inventor: Chung-Lung Chen, Taipei (TW)

(73) Assignee: BUTTON INTERNATIONAL CO., LTD., Taipei (TW)

( * ) Notice: Subject to any disclaimer, the term of this patent is extended or adjusted under 35 U.S.C. 154(b) by 0 days.

(21) Appl. No.: 17/571,868

(22) Filed: Jan. 10, 2022

(65) Prior Publication Data

US 2022/0322795 A1 Oct. 13, 2022

(30) Foreign Application Priority Data

Apr. 7, 2021 (TW) ..... 110112583

(51) Int. Cl.
*A44B 11/25* (2006.01)

(52) U.S. Cl.
CPC ..... *A44B 11/2526* (2013.01); *A44D 2203/00* (2013.01)

(58) Field of Classification Search
CPC ..... A44B 11/2526; A44B 11/258; A44D 2203/00
See application file for complete search history.

(56) References Cited

U.S. PATENT DOCUMENTS

| | | | | |
|---|---|---|---|---|
| 10,791,803 | B2 * | 10/2020 | Bevilacqua | A44B 11/2526 |
| 11,324,295 | B2 * | 5/2022 | Paik | A44B 11/258 |
| 11,533,970 | B1 * | 12/2022 | Tseng | A44B 11/2592 |
| 2009/0094809 | A1 * | 4/2009 | Kung | A44B 11/25 24/625 |

* cited by examiner

*Primary Examiner* — Robert Sandy
(74) *Attorney, Agent, or Firm* — Rabin & Berdo, P.C.

(57) ABSTRACT

A lever-controllable magnetic buckle includes a male member having a male engaging section, a female member having a female engaging section formed with two groups of female guide-out surface, and a control lever. The male member is magnetically attracted for moving to the female member with the male engaging section retained to the female engaging section. The control lever is pivotally connected to the male member and has an actuating cam contacting with the female member. The female member will contact with surfaces of the actuating cam at different positions thereof when the control lever is pivotally swung relative to the male member, allowing the male engaging section to disengage from the female engaging section. Then, the control lever can be further swung to move the male member in different directions to selectively contact with one of the two groups of female guide-out surface and be completely separated from the female member.

14 Claims, 21 Drawing Sheets

LEVER-CONTROLLABLE MAGNETIC BUCKLE

FIELD OF THE INVENTION

The present invention relates to a magnetic buckle having a male member and a female member magnetically engaged with each other and more particularly, to a magnetic buckle having a male member that can be selectively separated from a female member in any one of two directions.

BACKGROUND OF THE INVENTION

Following the advancement of industrial technologies, the structures and functions of buckles are constantly developed to show a variety of exquisite styles. A lot of objects, such as clothing, furniture and fixtures, sporting goods, safety gears and handbags, have specially designed buckles provided therewith.

Currently, there is a type of conventional magnetic buckle 1 commercially available in the market, which can be quickly fastened and released. Please refer to FIG. 1A. The conventional magnetic buckle 1 includes a male member 10, a female member 11 and a control lever 12. The male member 10 includes a buckling section 101 and has a male-side magnetic element 102 mounted therein. As shown, the buckling section 101 includes an extended portion 101*a* extended in a z-axis direction, and a retaining protrusion 101*b* extended from the extended portion 101*a* in an x-axis direction. The female member 11 includes a buckling space 111 and has a female-side magnetic element 112 mounted therein for magnetically attracting the male-side magnetic element 102 thereto. As shown, the buckling space 111 includes a receiving space 111*a* downward recessed in the z-axis direction and a retaining space 111*b* sideward recessed in the x-axis direction. The control lever 12 includes a push section 121 and a grip section 122. And, the control lever 12 is pivotally connected at a joint of the push section 121 and the grip section 122 to the male member 10, such that the control lever 12 is swingable relative to the male member 10.

Please refer to FIG. 1B. The male-side magnetic element 102 on the male member 10 is magnetically attracted for moving to the female-side magnetic element 112 on the female member 11, bringing the male member 10 to move toward the female member 11. At this point, the retaining protrusions 101*b* of the buckling section 101 first inserts into the receiving space 111*a* of the buckling space 111 and then moves from the receiving space 111*a* into the retaining space 111*b* of the buckling space 111. When the retaining protrusion 101*b* has completely moved into the retaining space 111*b*, the male member 10 is fastened to the female member 11.

Please refer to FIGS. 1B and 1C. The control lever 12 can be pivotally swung relative to the male member for the push section 121 of the control lever 12 to gradually move toward the female member 11. When the push section 121 is in contact with the female member 11, the control lever 12 can be further swung relative to the male member 10. As a result, the control lever 12 brings the male member 10 to move, bringing the retaining protrusion 101*b* of the buckling section 101 to move from the retaining space 111*b* of the buckling space 111 into the receiving space 111*a* of the buckling space 111, such that the male member 10 can be separated from the female member 20. However, the swinging of the control lever 12 can only cause the male member 10 to move leftward in the x-axis direction to separate from the female member 11 without the possibility of moving the male member 10 rightward in the x-axis direction to separate from the female member 11. That is, there is only one way to separate the male member 10 from the female member 11. In the case the conventional magnetic buckle 1 is used with clothing, backpack and other objects, the user or an operator has to learn the position of the conventional magnetic buckle 1 relative to the object. If the user or the operator does not correctly determine the relative position of the conventional magnetic buckle 1 to the object, it will be difficult to separate the male member 10 from the female member 11. Therefore, the conventional magnetic buckle 1 is disadvantageous for use because the male member 10 and the female member 11 thereof can not be conveniently separated from each other.

SUMMARY OF THE INVENTION

A primary object of the present invention is to provide a magnetic buckle with an improved structure, such that a male member thereof can be selectively separated from a female member in different manners. When the magnetic buckle of the present invention is mounted to an object, such as clothing or a backpack, a user can always quickly separate the male member from the female member no matter how the magnetic buckle is arranged on the object.

Another object of the present invention is to provide a magnetic buckle, of which a male member is engaged with a female member through a magnetic attraction of a male-side magnetic element to a female-side magnetic element, such that the male member is prevented from moving horizontally in an x-axis and a y-axis direction relative to the female member, and the male member having been engaged with the female member does not move horizontally to separate from the female member.

To achieve the above and other objects, the magnetic buckle according to the present invention is a lever-controllable magnetic buckle, which includes a male member, a female member and a control lever. The male member includes a male engaging section and a connecting section, and a male-side magnetic element is mounted in the male member. The female member includes a female engaging section and a guide section, and a female-side magnetic element is mounted in the female member. The female engaging section is formed at different locations with a female guide-in surface, a first female guide-out surface and a second female guide-out surface. The male-side magnetic element is magnetically attracted for moving to the female-side magnetic element, so that the male engaging section is engaged with the female engaging section after the male engaging section contacts with the female guide-in surface.

The control lever is pivotally connected to the connecting section and has an actuating cam for contacting with the guide section; the control lever is capable of swinging relatively with the male member so the surface of the actuating cam at different locations are pushed by the guide section, and the male engaging section is movable relative to the female member to separate from the female engaging section.

The male engaging section is separated from the female engaging section, the male member is capable of moving relatively with the female member along different directions; the male member will be separated from the female member after the male engaging section is selectively contacted with one of the first female guide-out surface and the second female guide-out surface.

In an embodiment, the connecting section includes a male limiting protrusion, and the control lever is selectively swingable to contact with or separate from the male limiting protrusion; and the control lever is stopped by the male limiting protrusion when the control lever in contact with the male limiting protrusion, so the swing angle of the control lever is limited by the male limiting protrusion.

The connecting section includes two connecting blocks spaced from each other, and both the actuating cam and the guide section are located between the two connecting blocks, such that the two connecting blocks and the actuating cam are located around the guide section so as the guide section is located among the control lever and the two connecting blocks for limiting the male member from moving horizontally relative to the female member.

The female member includes an auxiliary guide section spaced from the guide section, such that a surrounded space is formed between the guide section and the auxiliary guide section at one side of the female-side magnetic element; and the surrounded space is used to receive part of the male member. In this embodiment, the guide section has a cambered surface formed facing toward the surrounded space, and the actuating cam has a reset surface and a push surface located adjacent to the reset surface. The reset surface remains in contact with the cambered surface when the male-side magnetic element is magnetically attracted for moving to the female-side magnetic element, such that the male engaging section remains engaged with the female engaging section. And, when the push surface is in contact with the cambered surface, the male member is allowed to move relative to the female member.

The guide section further has a slant guide surface formed on one side adjacent to the cambered surface, such that the guide surface is located between the cambered surface and female guide-in surface and the guide surface is contactable with the male member to guide part of the male member into the surrounded space. A locating protrusion is upwardly formed at the top of the auxiliary guide section and a locating space is formed at the bottom of the control lever; the locating protrusion being extended into the locating space, such that the control lever is limited from moving horizontally by cooperation of the locating protrusion and the locating space. The auxiliary guide section further includes an auxiliary guide surface facing toward the surrounded space, such that the auxiliary guide surface is located between the locating protrusion and the first female guide-out surface; and the auxiliary guide surface is contactable with the male member to guide part of the male member into the surrounded space.

The female member further includes a first limiting section and a second limiting section. The guide section, the female engaging section and the auxiliary guide section are sequentially arranged in an x-axis direction; and the first limiting section, the female engaging section and the second limiting section are sequentially arranged in a y-axis direction.

In this embodiment, the female engaging section has engaging spaces downward recessed in a z-axis direction and retaining spaces sidewardly recessed in an x-axis direction. The engaging spaces respectively have an open end and an closed end located opposite to the open end, and the female guide-in surface are located adjacent to the open ends while the first female guide-out surface are formed from the open ends to the closed ends. Wherein the female guide-in surface and the first female guide-out surface are located at two opposite side of the engaging spaces in the x-axis direction, and the second female guide-out surface are vertically located below the female guide-in surface.

The male engaging section includes extended portions downward extended in a z-axis direction and retaining protrusions sideward extended from the extended portions in an x-axis direction. The extended portions have first male guide-out surfaces contactable with the first female guide-out surface, and the retaining protrusions have second male guide-out surfaces contactable with the second female guide-out surface and male guide-in surfaces contactable with the female guide-in surface. The second male guide-out surfaces and the male guide-in surfaces are located at two opposite sides of the retaining protrusions in a z-axis direction, and the first male guide-out surfaces are located at a lateral side of the male guide-in surfaces. And, the lever is moved toward the male member by a reset force that is generated form the male-side magnetic element, so that the lever remains in contact with the male member without suffering an external force.

The present invention is characterized in that the female engaging section of the female member is provided with the female guide-in surface, the first female guide-out surface and the second female guide-out surface; the first and the second female guide-out surface are used to separate the male engaging section from the female engaging section. Therefore, when the control lever is pivotally swung to separate the male engaging section from the female engaging section, the control lever under an externally applied pull force can selectively bring the male member to move in different directions, such that the male engaging section can selectively contact with the first female guide-out surface or the second female guide-out surface for the male member to separate from the female member. So that a user can select to separate the male member from the female member in different manners according to actual need.

Further, the connecting section of the male member includes two spaced connecting blocks and both the actuating cam of the control lever and the guide section of the female member are located between the two connecting blocks, such that the two connecting blocks and the actuating cam are located around the guide section. Therefore, when the male member is engaged with the female member due to the magnetic attraction of the male-side magnetic element to the female-side magnetic element, the guide section of the female member is located among the actuating cam of the control lever and the two connecting blocks for limiting the male member from moving horizontally relative to the female member. With this arrangement, the male member engaged with the female member is prevented from separating from the female member in a horizontal direction.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
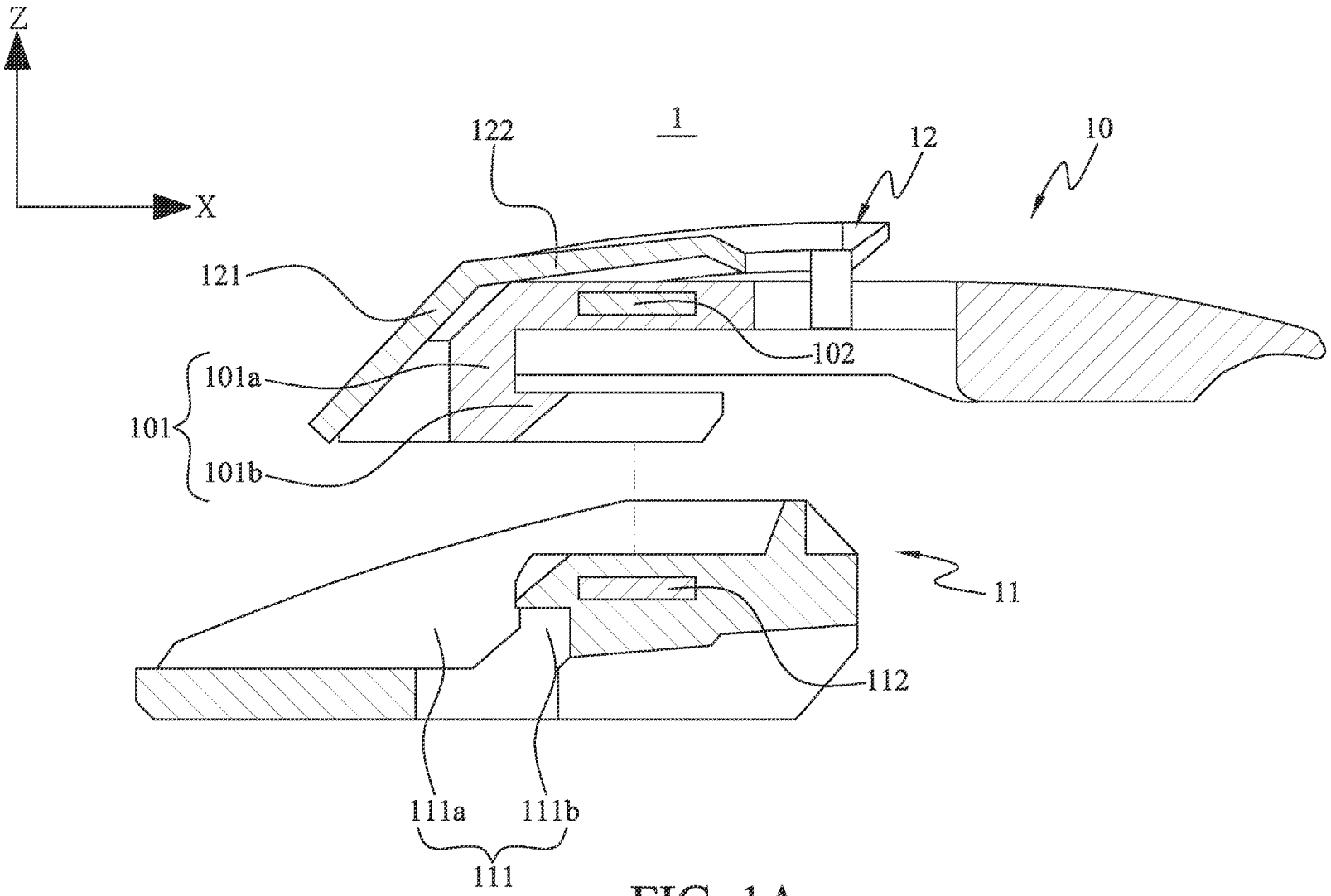
FIG. 1A (Prior Art)
FIG. 1A is an exploded sectional view of a conventional magnetic buckle.
Figure 1B:
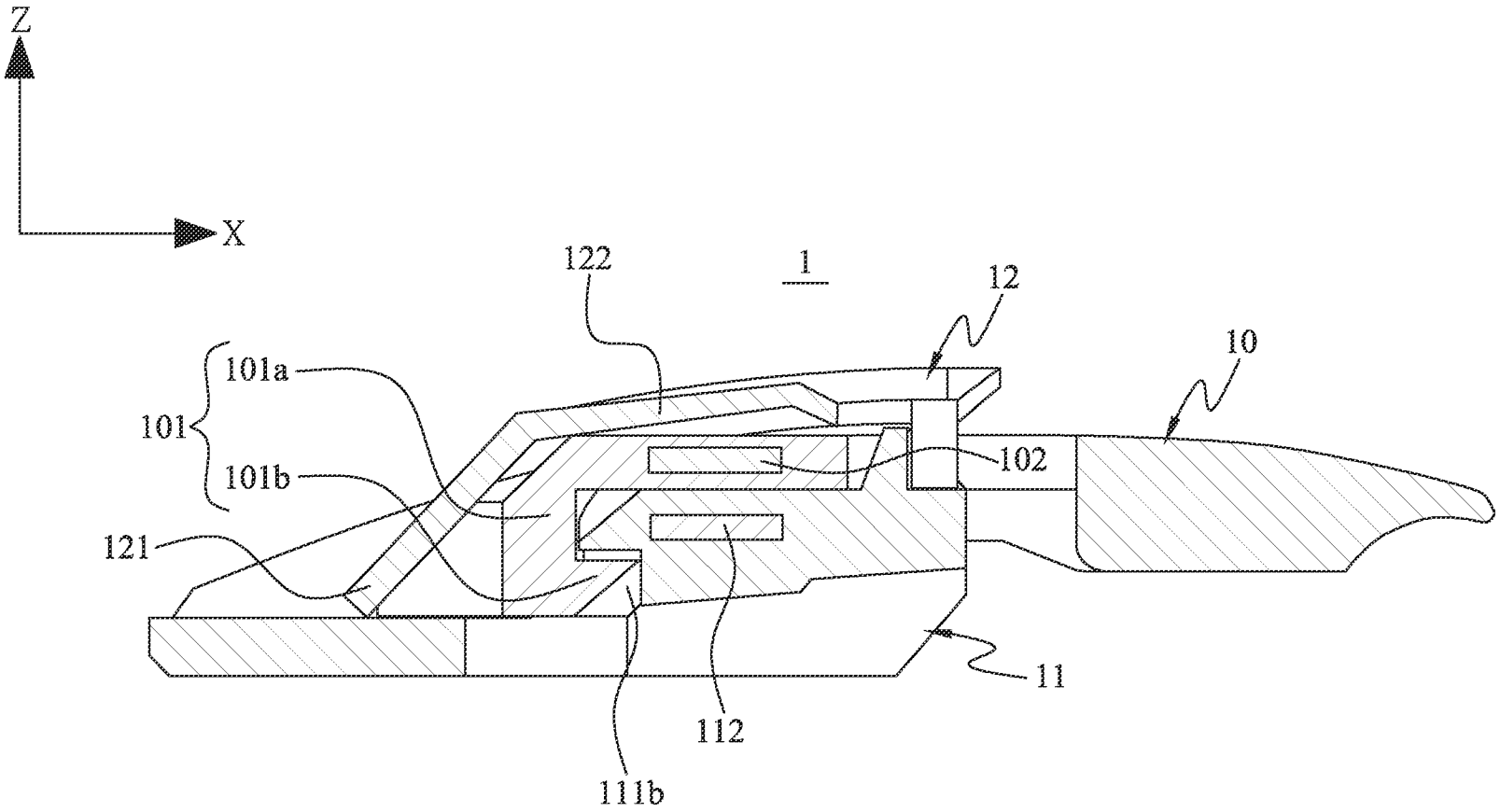
FIG. 1B (Prior Art)
FIG. 1B is an assembled view of the conventional magnetic buckle of FIG. 1A.
Figure 1C:
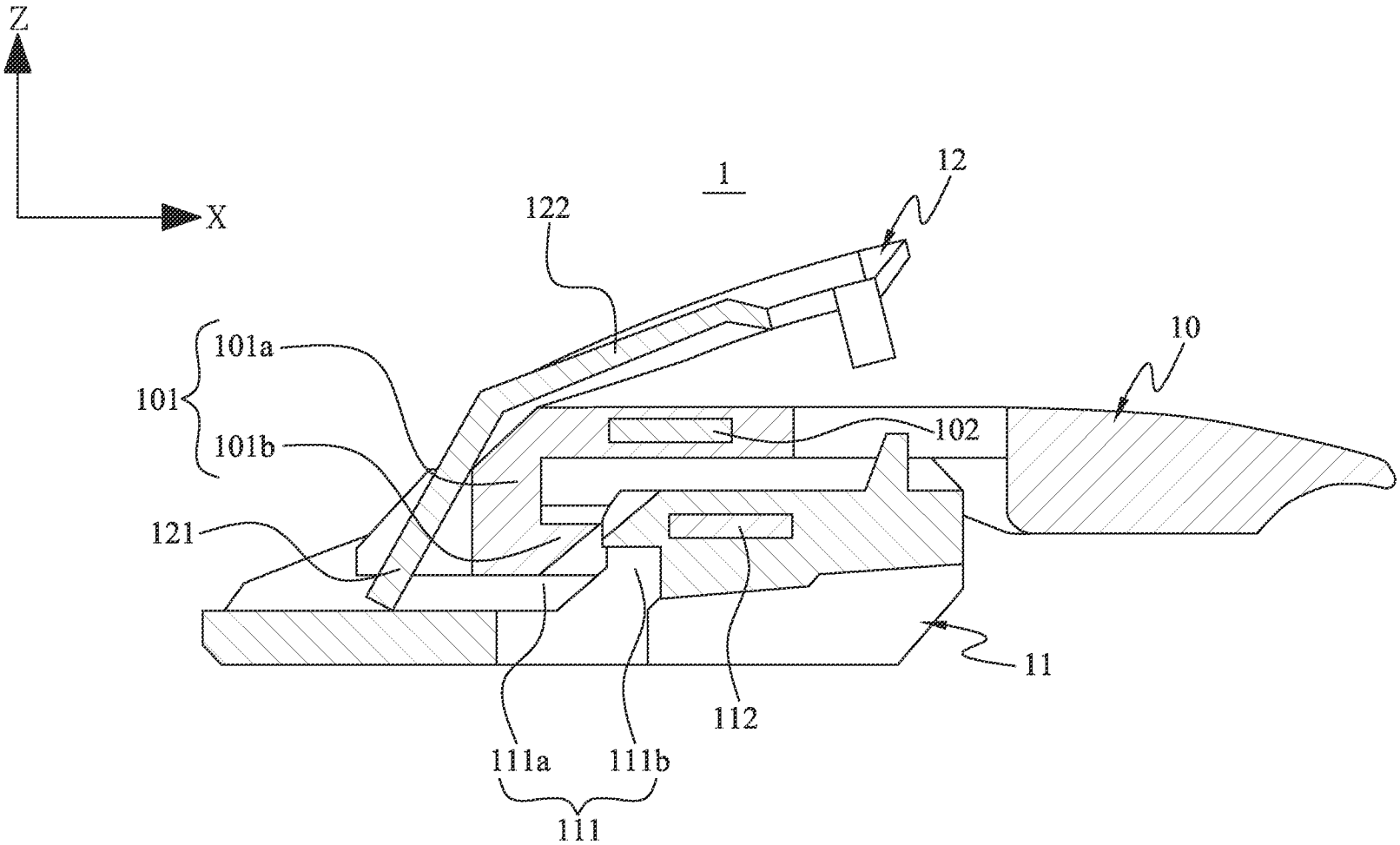
FIG. 1C (Prior Art)
FIG. 1C is an assembled sectional view showing a control lever of the conventional magnetic buckle of FIG. 1A is actuated to separate a retaining protrusion from a retaining space.

The present invention will now be described with some preferred embodiments thereof and by referring to the accompanying drawings. For the purpose of easy to understand, elements that are the same in the preferred embodiments are denoted by the same reference numerals.

To facilitate clear description of the lever-controllable magnetic buckle 2 according to the present invention, X, Y and Z axes are shown in the accompanying drawings where it is necessary. When viewing in front of the drawings, the X axis, the Y axis and the Z axis respectively indicate a longitudinal, a transverse and a vertical direction of the magnetic buckle. In the specification, directional terms, such as front, rear, right, left, upper and lower, are described based on the directions in which the X, Y and Z axes point, i.e. the x-axis, the y-axis and the z-axis direction.

Figure 2A:
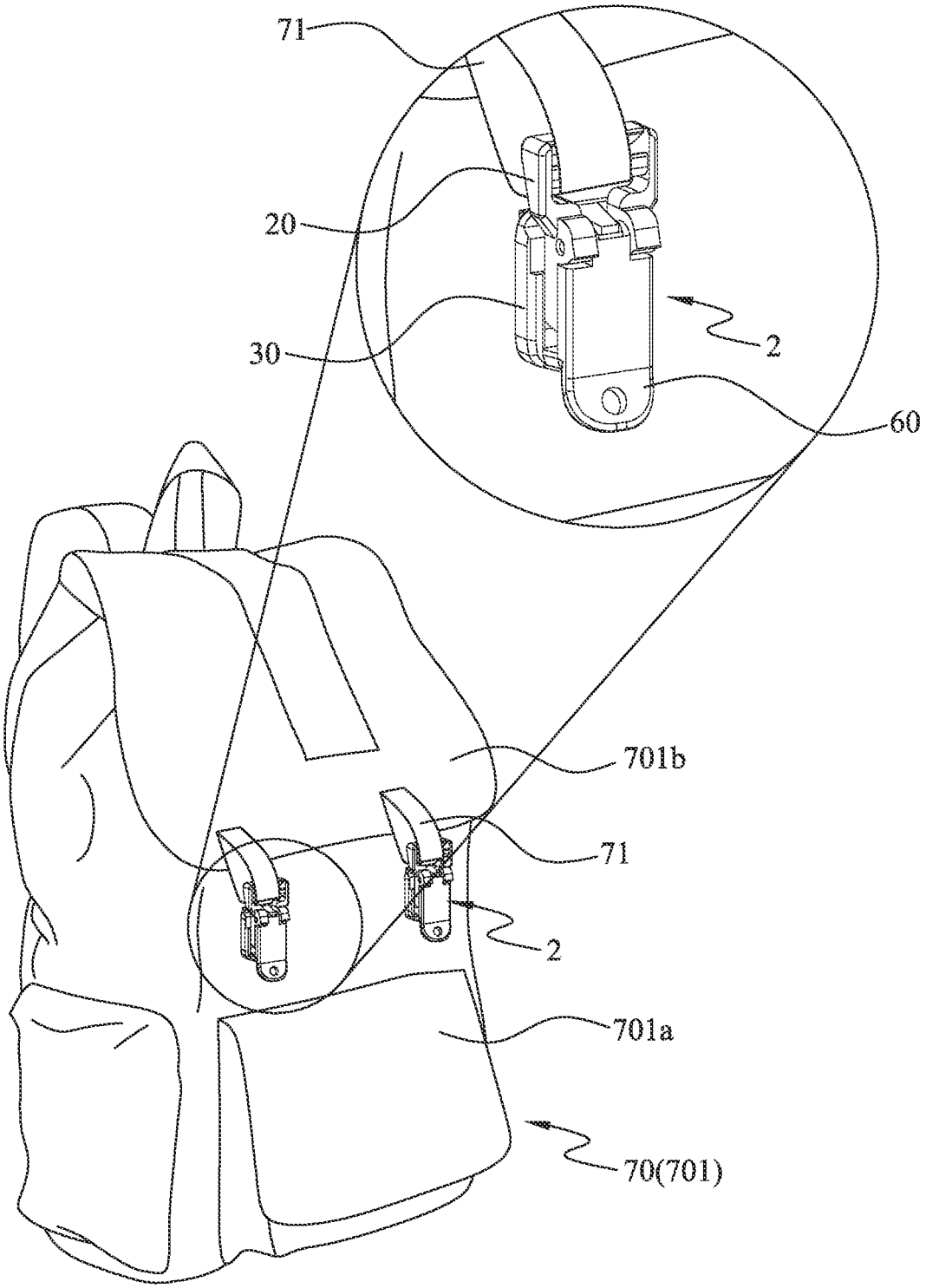
FIG. 2A shows the use of a lever-controllable magnetic buckle according to the present invention on a backpack.
Figure 2B:
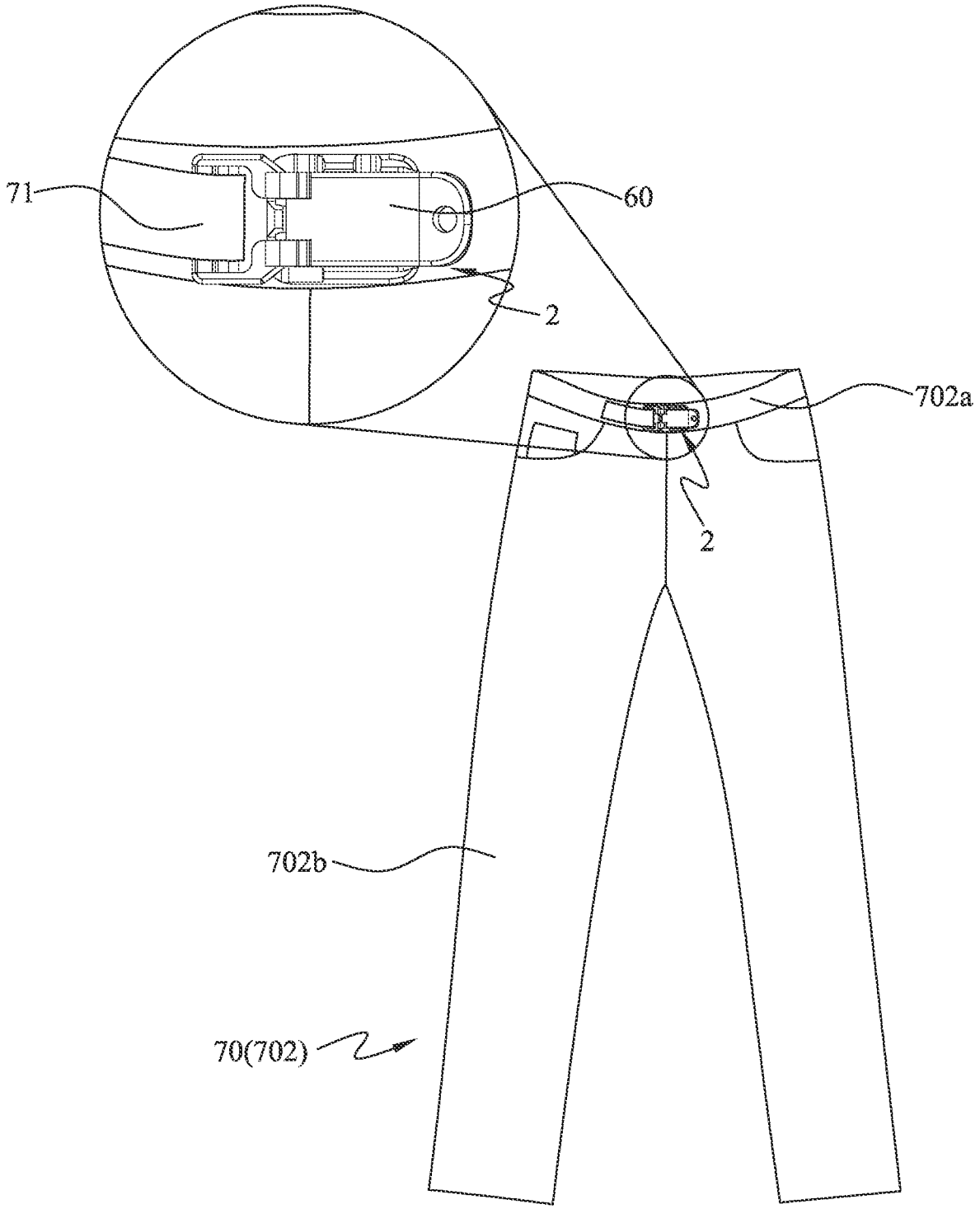
FIG. 2B shows the use of the lever-controllable magnetic buckle according to the present invention on a pair of trousers.

The lever-controllable magnetic buckle 2 according to the present invention is for use with an object 70, which includes a deformable belt 71. In FIG. 2A, the illustrated object 70 is a backpack 701 having a main body 701*a* for holding things therein and a flap 701*b* connected to the main body 701*a*. The belt 71 is connected to the flap 701*b*, and the lever-controllable magnetic buckle 2 is connected to between the main body 701*a* and the belt 71. However, it is understood the object 70 in the form of a backpack 701 is only illustrative without being limited thereto. In FIG. 2B, the illustrated object 70 is a pair of trousers 702. A top part of the trousers is a waistband 702*a* and other parts of the trousers are two trouser legs 702*b*. In this case, the belt 71 is wound around the waistband 702*a*, and the lever-controllable magnetic buckle 2 is connected to between the waistband 702*a* and the belt 71.

Figure 3:
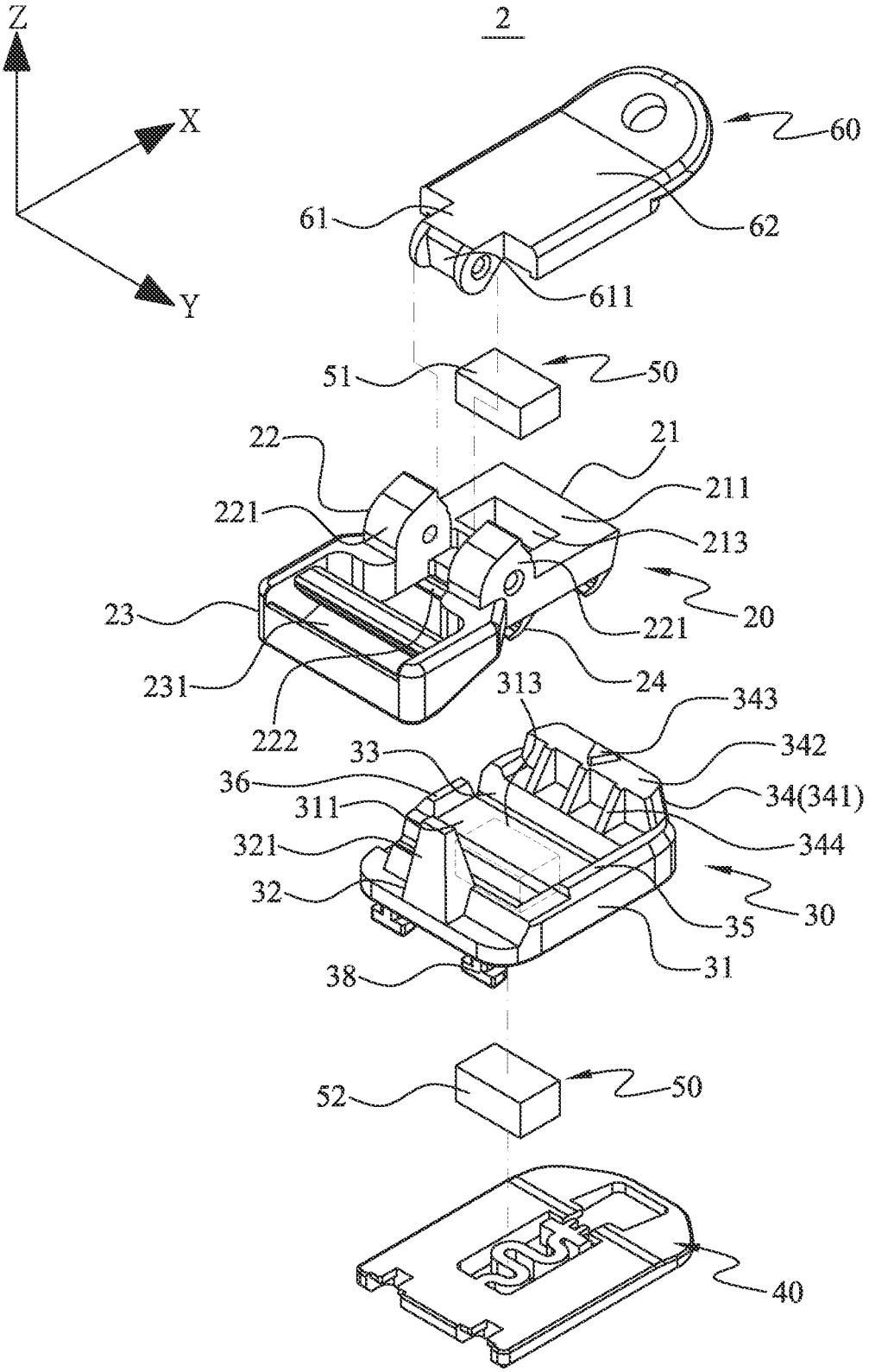
FIG. 3 is an exploded perspective view of the lever-controllable magnetic buckle according to a first preferred embodiment of the present invention.
Figure 4A:
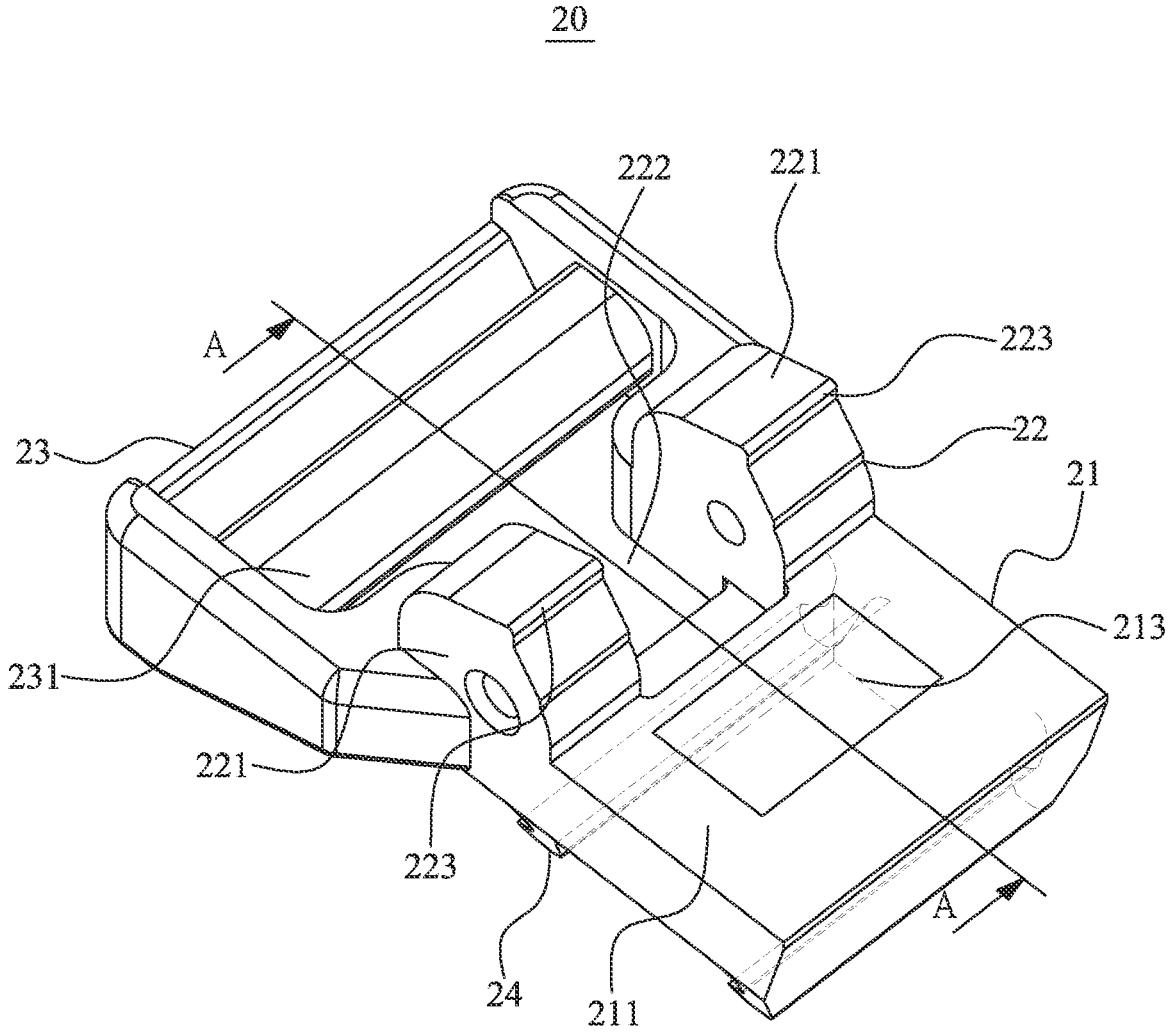
FIG. 4A is a perspective view of a male member for the lever-controllable magnetic buckle according to the first preferred embodiment of the present invention.
Figure 4B:
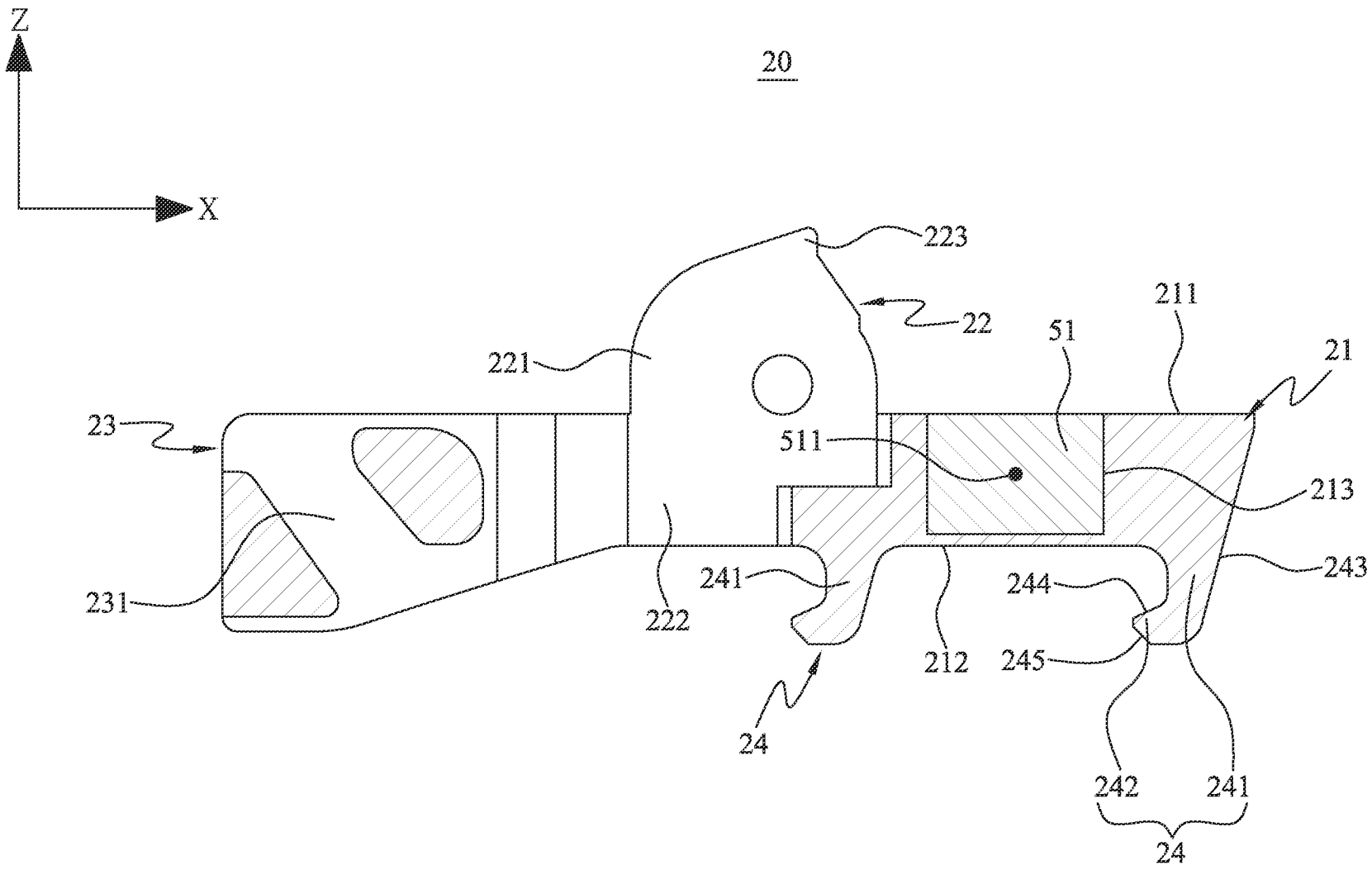
FIG. 4B is a sectional view taken in line A-A of FIG. 4A.

Please refer to FIG. 3. The lever-controllable magnetic buckle 2 according to a first preferred embodiment of the present invention includes a male member 20, a female member 30, a base plate 40, a magnetic unit 50 and a control lever 60. Please refer to FIGS. 4A and 4B along with FIG. 3. The male member 20 includes a male buckling body 21, a connecting section 22 and a male-side protruded section 23. An upper and a lower side of the male buckling body 21 in the z-axis direction are defined as a male limiting surface 211 and a male contact surface 212, respectively. The male contact surface 212 is located lower than the male limiting surface 211. As shown in FIGS. 3, 4A and 4B, the male buckling body 21 is sunken from the male limiting surface 211 toward the male contact surface 212, such that a male receiving space 213 is formed in the male member 20. Further, the male member 20 includes a male engaging section 24, which is downward extended from the male buckling body 21 in the z-axis direction to be located opposite to the male receiving space 213. In the first preferred embodiment, the male engaging section 24 includes two extended portions 241, which are downward extended from the male contact surface 212 of the male buckling body 21 in the z-axis direction. The two extended portions 241 are spaced from each other in the x-axis direction, and respectively have a distal end opposite to the male buckling body 21 being extended leftward in the x-axis direction to form a retaining protrusion 242. One side of each of the extended portions 241 opposite to the retaining protrusion 242, i.e. the right side of the extended portion 241, is formed into a leftward slant first male guide-out surface 243. One side of each of the retaining protrusions 242 closer to the male buckling body 21, i.e. the upper side of the retaining protrusion 242, is formed into a slant second male guide-out surface 244; and another side of each of the retaining protrusions 242 farther away from the male buckling body 21, i.e. the lower side of the retaining protrusion 242, is formed into a slant male guide-in surface 245; such that the second male guide-out surface 244 and the male guide-in surface 245 are located at two opposite side of the retaining protrusion 242 in the z-axis direction. Further, both the second male guide-out surfaces 244 and the male guide-in surfaces 245 are located at a lateral side of the first male guide-out surfaces 243 in the x-axis direction.

Please refer to FIGS. 4A and 4B. The connecting section 22 is located between the male buckling body 21 and the male-side protruded section 23. In the first preferred embodiment, the connecting section 22 includes two connecting blocks 221, one of which is located at a front side the male member 20 in the y-axis direction, while the other one is located at a rear side of the male member 20 in the y-axis direction, such that the two connecting blocks 221 are spaced from each other and a separated space 222 is defined among the two connecting blocks 221, the male buckling body 21 and the male-side protruded section 23. Further, each of the two connecting blocks 221 is upward extended to form a male limiting protrusion 223. The male-side protruded section 23 of the male member 20 is provided with an assembling space 231. The belt 71 of the object 70 is extended through the assembling space 231 to connect the male member 20 to the object 70, as shown in FIG. 2A.

Figure 5A:
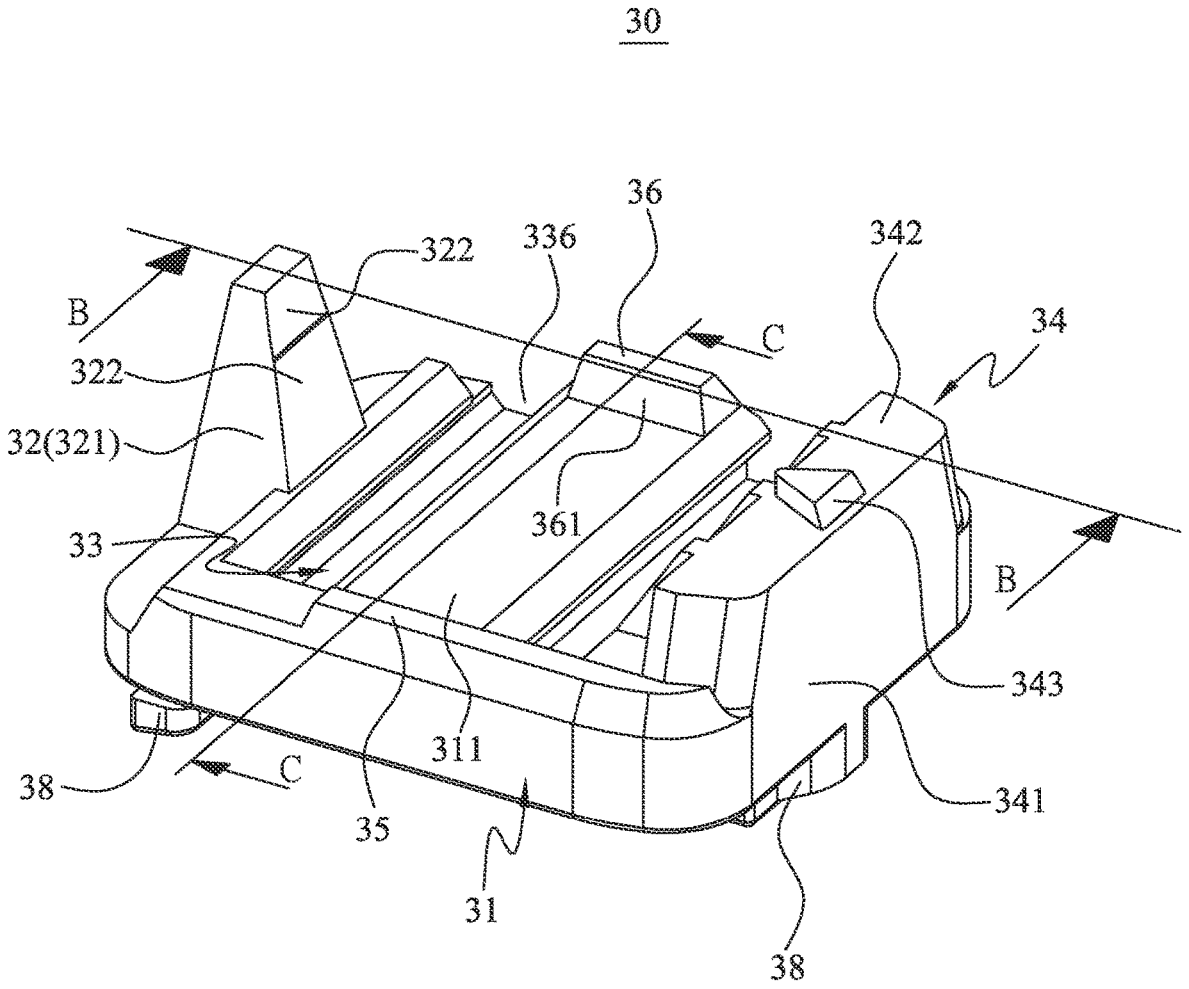
FIG. 5A is a perspective view of a female member for the lever-controllable magnetic buckle according to the first preferred embodiment of the present invention.
Figure 5B:
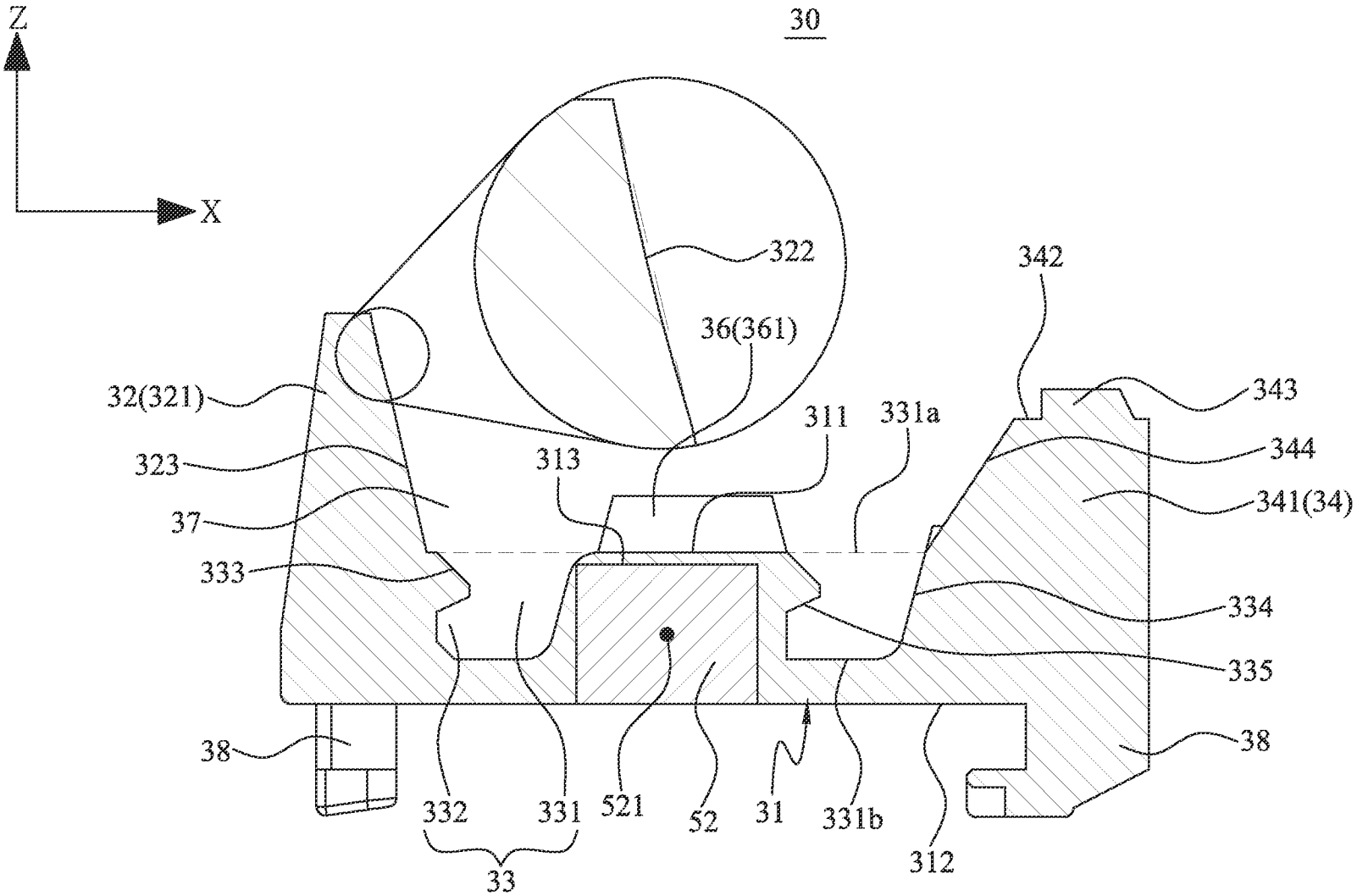
FIG. 5B is a sectional view taken in line B-B of FIG. 5A.
Figure 5C:
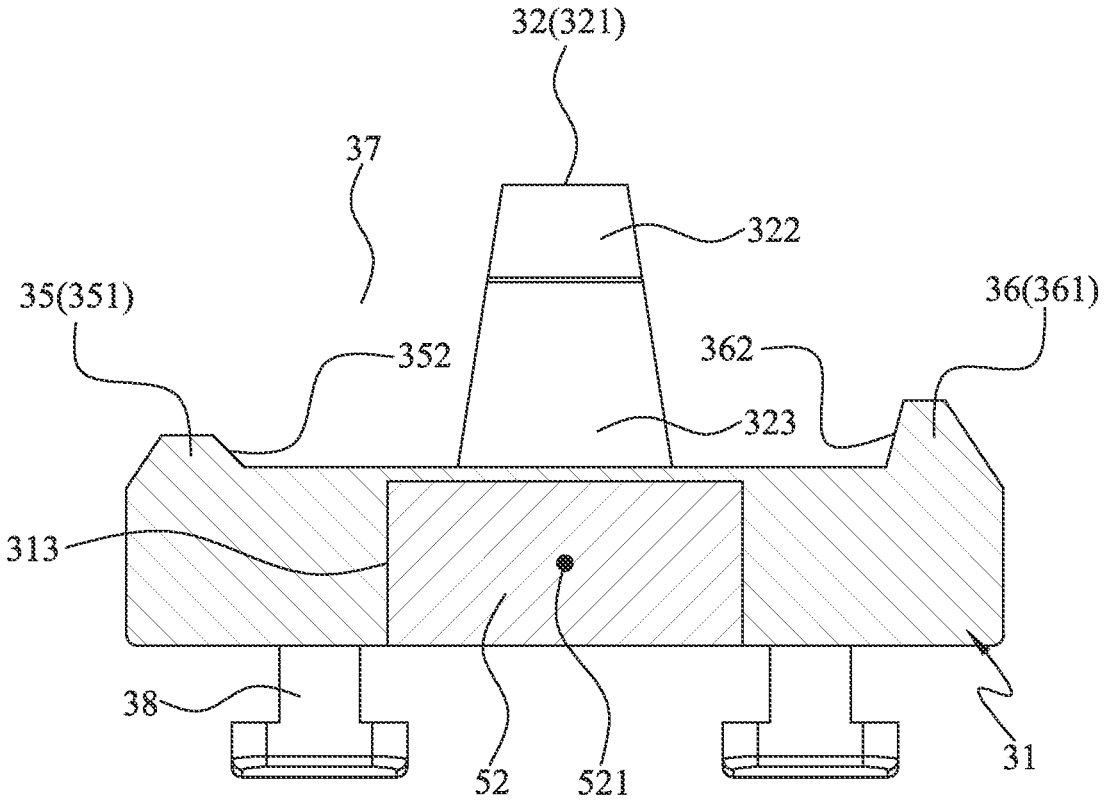
FIG. 5C is a sectional view taken in line C-C of FIG. 5A.

Please refer to FIGS. 5A, 5B and 5C. The female member 30 has a portion formed into a female buckling body 31. An upper and a lower side of the female buckling body 31 in the z-axis direction are defined as a female contact surface 311 and a female abutting surface 312, respectively. The female abutting surface 312 is located at a level height lower than the female contact surface 311. The female buckling body 31 is sunken from the female abutting surface 312 toward the female contact surface 311, such that a female receiving space 313 is formed in the female member 30. The female member 30 further includes a guide section 32, a female engaging section 33 and an auxiliary guide section 34 that are sequentially formed on a top of the female contact surface 311 in the x-axis direction. The female member 30 further includes a first limiting section 35 and a second limiting section 36 located at a front and a rear side of the female engaging section 33 in the y-axis direction, such that the first limiting section 35, the female engaging section 33 and the second limiting section 36 are sequentially arranged in the y-axis direction. In the first preferred embodiment, the guide section 32 is configured as a guide post 321 upwardly tapered from the female contact surface 311 in the z-axis direction. One side of the guide post 321 facing toward the auxiliary guide section 34 is formed into a cambered surface 322 having a certain curvature and a slantly extended guide surface 323. The female engaging section 33 is so configured that it has two engaging spaces 331 that are downward recessed in the z-axis direction. One of the two engaging spaces 331 is located to the left side of the female receiving space 313 while the other engaging space 331 is located to the right side of the female receiving space 313, such that the female receiving space 313 is located between the two engaging spaces 331. Each of the two engaging spaces 331 has an open end 331*a* located at the same level height of the female contact surface 311, and a closed end 331*b* located opposite to the open end 331*a*. In each of the engaging spaces 331, the closed end 331*b* is recessed leftward in the x-axis direction to form a retaining space 332. As shown, the female engaging section 33 includes a slant female guide-in surface 333 and a slant first female guide-out surface 334 formed in each of the engaging spaces 331; and the female engaging section 33 further includes a slant second female guide-out surface 335 formed in each of the retaining spaces 332. In the first preferred embodiment, the female guide-in surfaces 333 are located adjacent to the open ends 331*a* and near one side of the engaging spaces 331 having the retaining spaces 332 formed thereat, such that the female guide-in surfaces 333 are located vertically above the second female guide-out surfaces 335 in the z-axis direction. Wherein, one of the female guide-in surfaces 333 that is formed in the left female engaging space 331 is located at one end of the guide surface 323 opposite to the cambered surface 323, such that the guide surface 323 is located between the female guide-in surface 333 and the cambered surface 322. The first female guide-out surfaces 334 are located on one side of the engaging spaces 331 opposite to the retaining spaces 332, such that the female guide-in surfaces 333 and the first female guide-out surfaces 334 are located in the engaging spaces 331 at two opposite sides in the x-axis direction. In the first preferred embodiment, the first female guide-in surfaces 333 are slantly extended from the open end 331*a* to the closed end 331*b*, and the first female guide-out surfaces 334 respectively have one end located adjacent to the open end 331*a* and another opposite end located adjacent to the closed end 331*b*. As shown, the female engaging section 33 has two release openings 336 formed at a rear side of the female buckling body 31 to communicate with both of the engaging spaces 331 and the retaining spaces 332.

The auxiliary guide section 34 of the female member 30 is configured as an auxiliary guide wall 341, which is located opposite to and spaced from the guide post 321. A top of the auxiliary guide wall 341 is formed into a horizontally extended female limiting surface 342. A portion of the auxiliary guide wall 341 is upward protruded from the female limiting surface 342 to form a locating protrusion 343. The auxiliary guide wall 341 of the female member 30 includes a slant auxiliary guide surface 344 located on one side thereof that faces the guide post 321 of the guide section 32, and the auxiliary guide surface 344 is located adjacent to the first female guide-out surface 334 formed in the right engaging space 331 of the female engaging section 33, such that the auxiliary guide surface 344 is located between the locating protrusion 343 and the first female guide-out surface 334. The first limiting section 35 of the female member 30 is located opposite to the releasing opening 336 and has a first limiting wall 351 risen from the female buckling body 31 in the z-axis direction. One side of the first limiting wall 351 located closer to the female engaging section 33 is a slant first limiting surface 352. The second limiting section 36 of the female member 30 is located adjacent to the releasing opening 336 and has a second limiting wall 361 risen from the female buckling body 31 in the z-axis direction. One side of the second limiting wall 361 located closer to the female engaging section 33 is a second limiting surface 362 facing toward the first limiting surface 352. As the first limiting surface 352, the second limiting surface 362 is a slant surface.

As shown in FIGS. 5A to 5C, the guide post 321, the auxiliary guide wall 341, the first limiting wall 351 and the second limiting wall 361 of the female member 30 together define a surrounded space 37 atop the female buckling body 31. The surrounded space 37 is communicable with the two engaging spaces 331 of the female engaging section 33. Wherein, the guide surface 323 of the guide post 32, the auxiliary guide surface 344 of the auxiliary guide wall 341, the first limiting surface 352 of the first limiting wall 351 and the second limiting surface 362 of the second limiting wall 361 all are facing toward the surrounded space 37.

Figure 6:
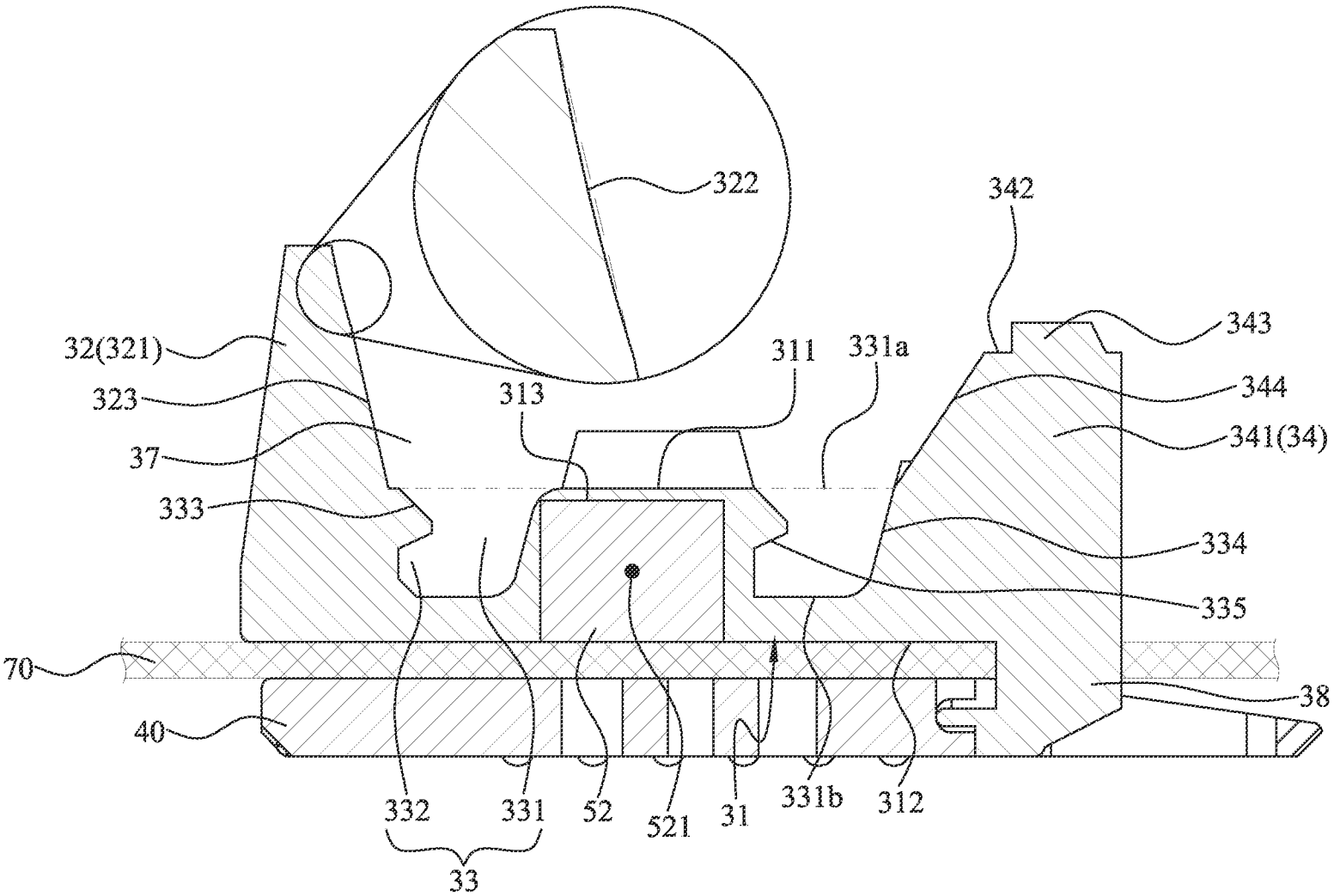
FIG. 6 is a sectional view showing the female member of FIG. 5A is assembled to a base plate.

Please refer to FIGS. 3 and 6. The female member 30 further includes two sets of connecting legs 38 downward extended from the female abutting surface 312 of the female buckling body 31. The connecting legs 38 are engaged with the base plate 40, such that the female abutting surface 312 of the female member 30 and the base plate 40 are together firmly clamped to the main body 701*a* of the backpack 701, as shown in FIG. 2A, or to the waistband 702*a* of the trousers 702, as shown in FIG. 2B.

Please refer to FIGS. 4B and 5B. The magnetic unit 50 includes a male-side magnetic element 51 and a female-side magnetic element 52. The male-side and the female-side magnetic element 51, 52 can move toward each other due to a magnetically attractive force between them. The male-side magnetic element 51 is mounted in the male receiving space 213 of the male member 20 while the female-side magnetic element 52 is mounted in the female receiving space 323 of the female member 30.

Figure 7A:
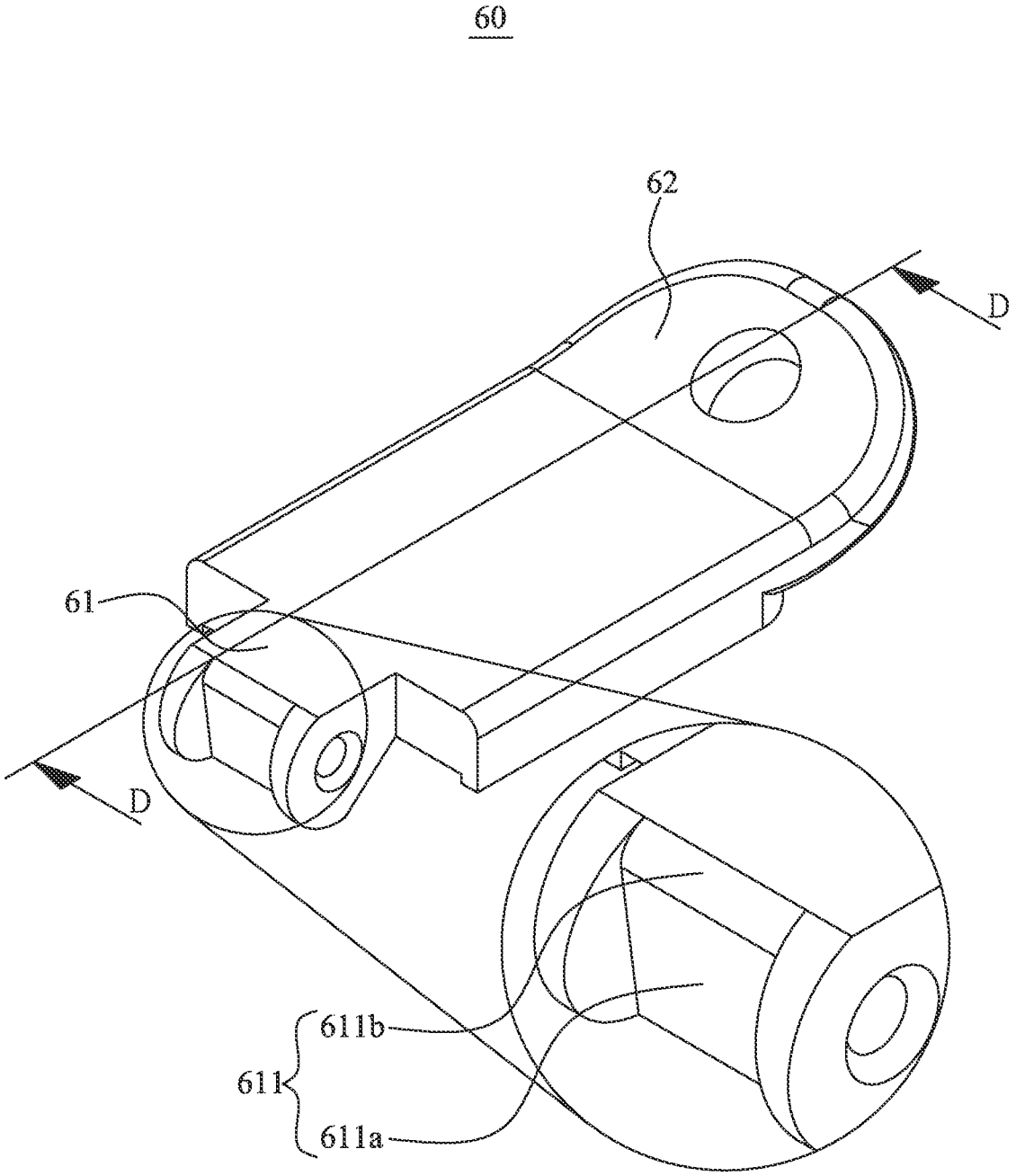
FIG. 7A is a perspective view of a control lever for the lever-controllable magnetic buckle according to the first preferred embodiment of the present invention.
Figure 7B:
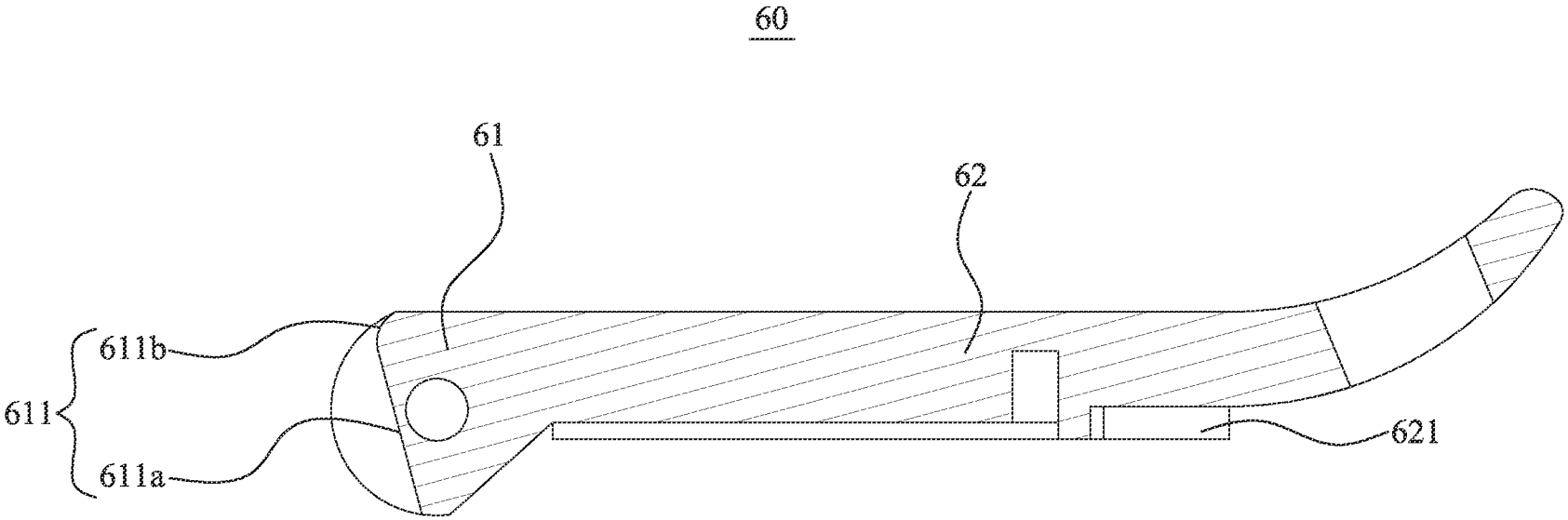
FIG. 7B is a sectional view taken in line D-D of FIG. 7A.

Please refer to FIGS. 3, 7A and 7B. The control lever 60 includes an actuating cam 61 and a lever portion 62 formed on the actuating cam 61. The actuating cam 61 is pivotally connected to between the two connecting blocks 221 of the connecting section 22 of the male member 20, such that the actuating cam 61 is located in the separated space 222 of the male member 20. As shown, the actuating cam 61 has an actuating contour 611 formed on an outer surface thereof. In the first preferred embodiment, a partial area of the actuating contour 611 is configured into a reset surface 611*a*, and the remaining area of the actuating contour 611 is configured into a push surface 611*b* located adjacent to one side of the reset surface 611*a*. Further, a lower side of the lever portion 62 is upward recessed to form a locating space 621. In the first preferred embodiment, the control lever 60 is made of a magnetic material.

Figure 8A:
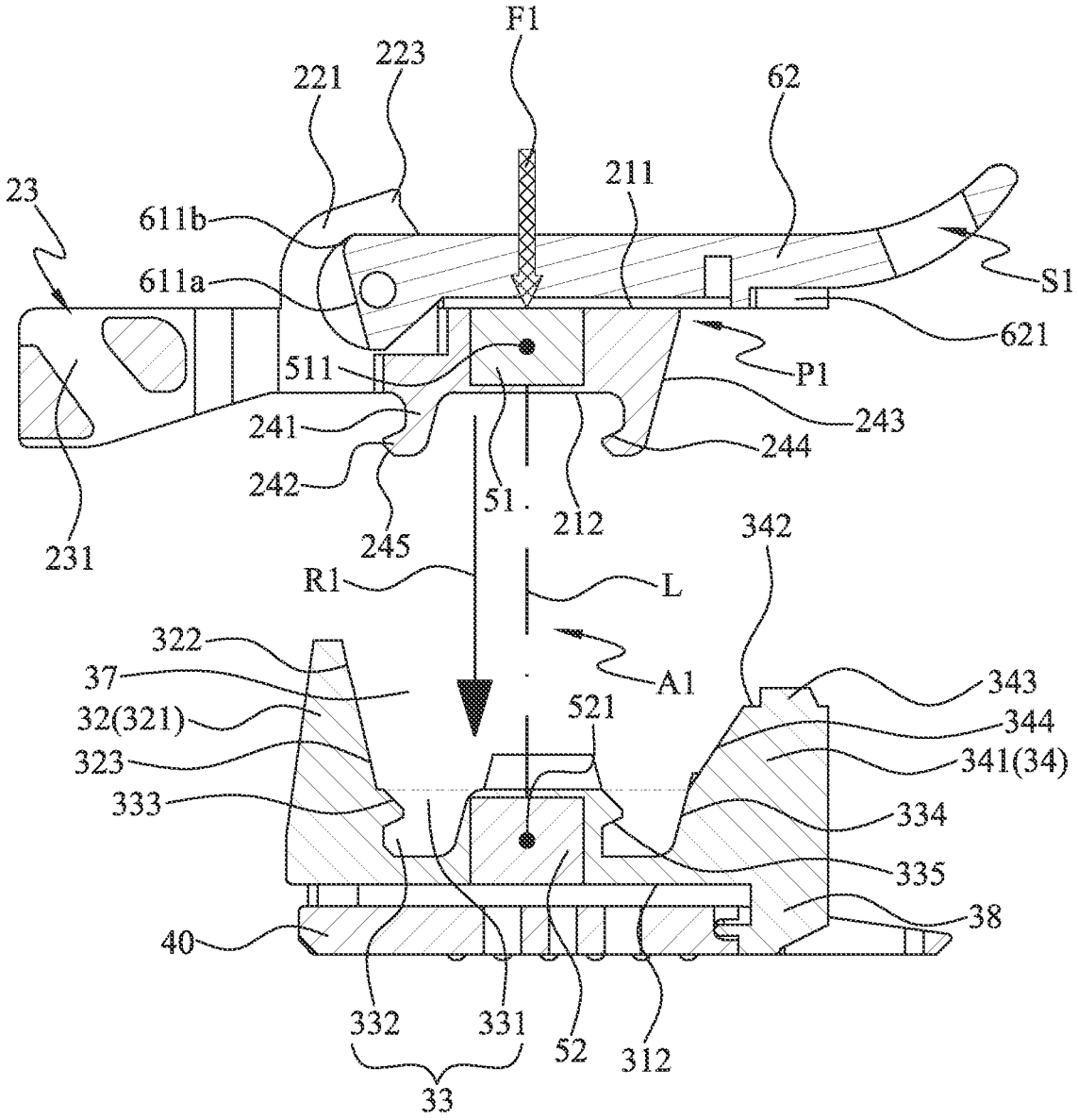
FIG. 8A is a sectional view showing the male member with the control lever connected thereto is located at a position separated from the female member.

Please refer to FIG. 8A. To assemble the male member 20 to the female member 30, first put the male member 20 at a separated position P1, in which the male engaging section 24 of the male member 20 does not contact with the female member 30. As shown, when the male member 20 is in the separated position P1, the male-side magnetic element 51 of the magnetic unit 50 is magnetically attracted to the control lever 60 and generates a reset force F1 between the male member 20 and the control lever 60, such that the control lever 60 can move gradually toward the male buckling body 21 under the reset force F1 and stops moving further when it touches the male limiting surface 211 of the male buckling body 21. At this point, the control lever 60 is located at an initial position S1, and a male center of gravity 511 of the male-side magnetic element 51 and a female center of gravity 521 of the female-side magnetic element 52 are located on the same vertical line L, such that the male-side magnetic element 51 is superposed on the female-side magnetic element 52 and the male-side and the female-side magnetic element 51, 52 are now in a mutually aligned state A1. In the first preferred embodiment, the vertical line L is in parallel with the Z axis.

Figure 8B:
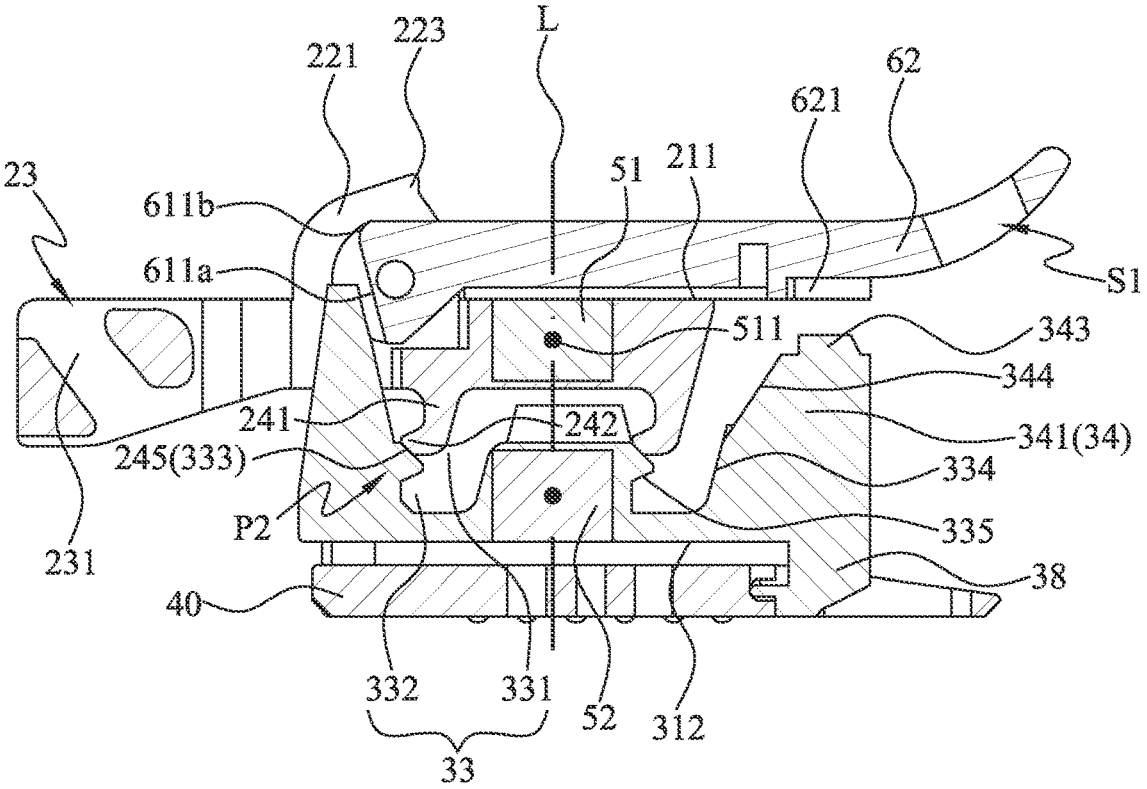
FIG. 8B is a sectional view showing the male member with the control lever connected thereto is located at a position in initial contact with the female member.

Please refer to FIG. 8B. When the male-side magnetic element 51 of the magnetic unit 50 is magnetically attracted for moving to the female-side magnetic element 52 of the magnetic unit 50, the male member 20 is brought to move gradually from the separated position P1 toward the female member 30 along a first assembling path R1 parallel with the Z axis, as indicated in FIG. 8A. When the male member 20 moves toward the female member 30, the male engaging section 24 of the male member 20 is eventually in contact with the guide surface 323 of the guide section 32 or the auxiliary guide surface 344 of the auxiliary guide section 34, bringing the male buckling body 21 of the male member 20 into the surrounded space 37. At the time the male engaging section 24 of the male member 20 touches the female engaging section 33 of the female member 30, the male member 20 is in an initial contact position P2. When the male member 20 is in the initial contact position P2, the male guide-in surfaces 245 of the male engaging section 24 are in contact with the female guide-in surfaces 333 of the female engaging section 33. At this point, the male-side magnetic element 51 and the female-side magnetic element 52 are still in the mutually aligned state A1.

Figure 8C:
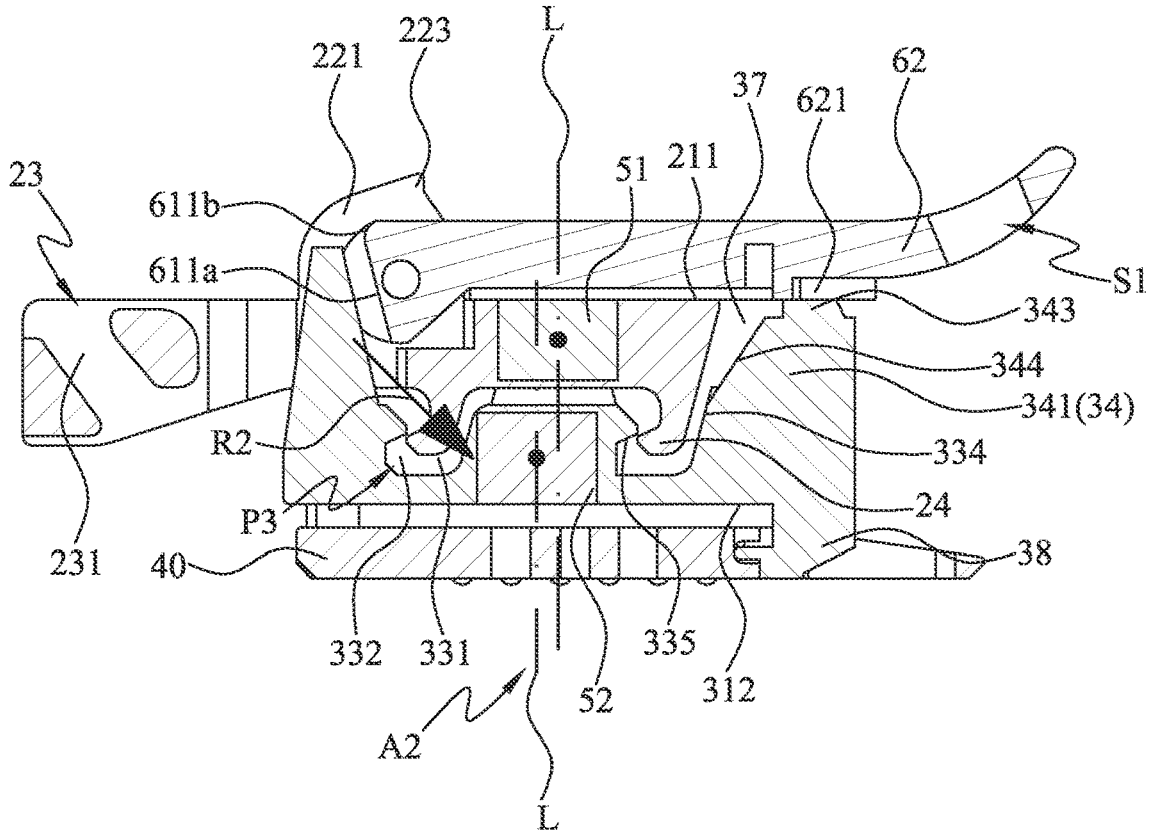
FIG. 8C is a sectional view showing the male member with the control lever connected thereto is located at a position in loose contact with the female member.

Please refer to FIG. 8C. When the male member 20 is in the initial contact position P2, the male-side magnetic element 51 of the magnetic unit 50 is still magnetically attracted for moving to the female-side magnetic element 52 of the magnetic unit 50, and the magnetically attractive force between them brings the male guide-in surfaces 245 of the male member 20 in contact with the female guide-in surfaces 333 of the female member 30 to move from the initial contact position P2 along a second assembling path R2, which is slant relative to the X and the Z axis, causing the entire male engaging section 24 of the male member 20 to move toward an inner side of the female engaging section 33 until the male contact surface 212 of the male member 20 is in contact with the female contact surface 311 of the female member 30. At this point, the male member 20 is moved from the initial contact position P2 to a loose contact position P3. As shown, when the male member 20 is in the loose contact position P3, the extended portions 241 and the retaining protrusions 242 of the male engaging section 24 are located in the engaging spaces 331 of the female engaging section 33, while the male-side magnetic element 51 overlaps the female-side magnetic element 52. Therefore, the male center of gravity 511 of the male-side magnetic element 51 and the female center of gravity 521 of the female-side magnetic element 52 are separately located at two different vertical lines L. At this point, the male-side magnetic element 51 and the female-side magnetic element 52 are in a staggered state A2.

Figure 8D:
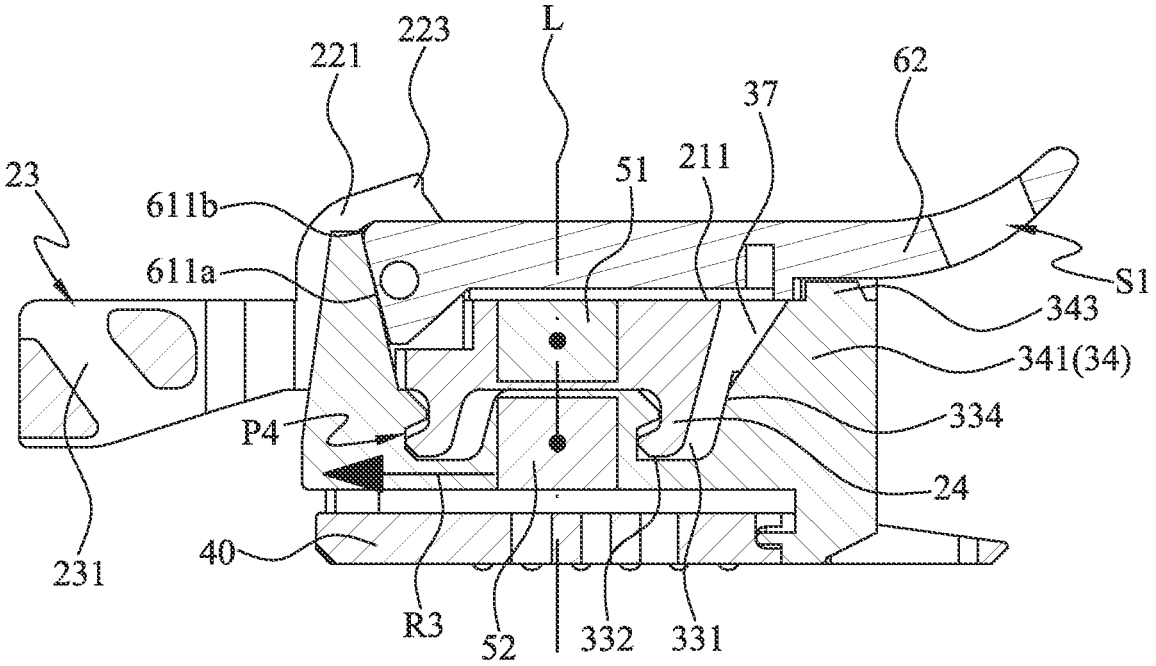
FIG. 8D is a sectional view showing the male member with the control lever connected thereto is located at a position engaged with the female member.

Please refer to FIG. 8D. When the male member 20 is moving from the initial contact position P2 to the loose contact position P3, the male buckling body 21 of the male member 20 can touch the first limiting surface 352 of the first limiting section 35 or the second limiting surface 362 of the second limiting section 36 to ensure the contact of the male contact surface 212 of the male member 20 with the female contact surface 311 of the female member 30 and accordingly, to prevent the retaining protrusions 242 of the male engaging section 24 from moving out of the engaging spaces 331 of the female engaging section 33 via the release openings 336 of the female engaging section 33. Further, when the male guide-in surfaces 245 of the male engaging section 24 are not in contact with the female guide-in surfaces 333 of the female engaging section 33, the male member 20 is brought by the magnetically attractive force between the male-side magnetic element 51 and the female-side magnetic element 52 to move along a third assembling path R3 in parallel with the X axis, such that the male member 20 is moved from the loose contact position P3 to an engaged position P4, in which the male engaging section 24 is engaged with the female engaging section 33. In the first preferred embodiment, when the male member 20 is in the engaged position P4, the retaining protrusions 242 of the male engaging section 24 are set in the retaining spaces 332 of the female engaging section 33 with the extended portions 241 of the male engaging section 24 located in the engaging spaces 331 of the female engaging section 33. Meanwhile, the male-side magnetic element 51 and the female-side magnetic element 52 of the magnetic unit 50 are changed from the staggered state A2 into the aligned state A1 again, making the retaining protrusions 242 firmly set in the retaining spaces 332. With these arrangements, when the male engaging section 24 is set in the female engaging section 33, the flap 701*b* of the backpack 70 in FIG. 2A can not be turned open to thereby protect things in the main body 701*a* from falling out of the backpack 70; or, in the case of a pair of trousers 702 in FIG. 2B, when the male engaging section 24 is set in the female engaging section 33, the waistband 702*a* of the trousers 702 can be tied around a wearer's waist to avoid the trousers 702 from sliding off the wearer's legs.

Figure 8E:
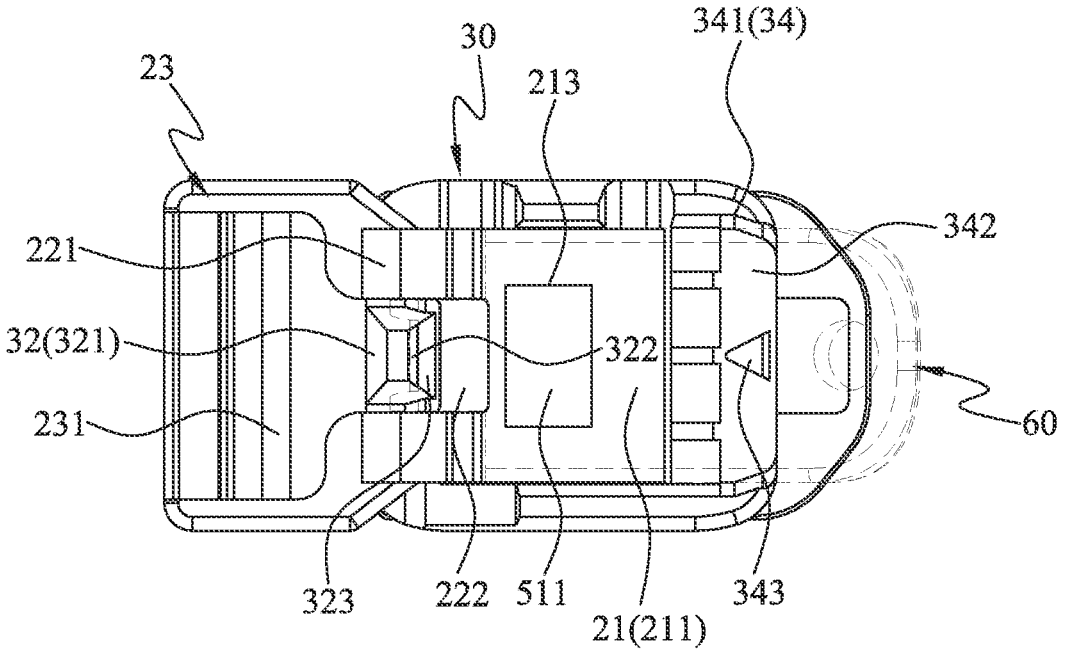
FIG. 8E is a bottom view showing a guide section of the female member is located in a separated space of the male member.

Please refer to FIGS. 8D and 8E at the same time. When the retaining protrusions 242 of the male member 20 are located in the retaining spaces 332 of the female member 30, the male buckling body 21 of the male member 20 is located in the surrounded space 37 of the female member 30 and limited by the surrounding guide post 321, the auxiliary guide wall 341, the first limiting wall 351 and the second limiting wall 361 from moving in the x-axis and y-axis directions; meanwhile, the male contact surface 212 of the male buckling body 21 is in contact with the female contact surface 311 of the female buckling body 31 and the guide section 32 of the female member 30 is extended into the separated space 222 of the male member 20, such that the guide post 321 of the guide section 32 is located among the two connecting blocks 221 of the connecting section 22 and the actuating cam 61 of the control lever 60 to thereby limit the male member 20 from moving relative to the female member 30 along the X axis and the Y axis. At this point, the male limiting surface 211 of the male buckling body 21 is flush with the female limiting surface 342 of the female buckling body 31, so that the control lever 60 is in contact at a lower side thereof with both of the male limiting surface 211 and the female limiting surface 342. Meanwhile, the locating protrusion 343 of the auxiliary guide section 34 is upward extended into the locating space 621 of the control lever 60, and the engagement of the locating protrusion 343 with the locating space 621 limits the control lever 60 from moving horizontally in the x-axis and the y-axis direction. It is to be noted that the cambered surface 322 of the guide post 321 is in contact with only the reset surface 611*a* of the actuating cam 61 when the locating protrusion 343 is extended into the locating space 621, so that the retaining protrusions 242 remain setting in the retaining spaces 332.

Figure 9A:
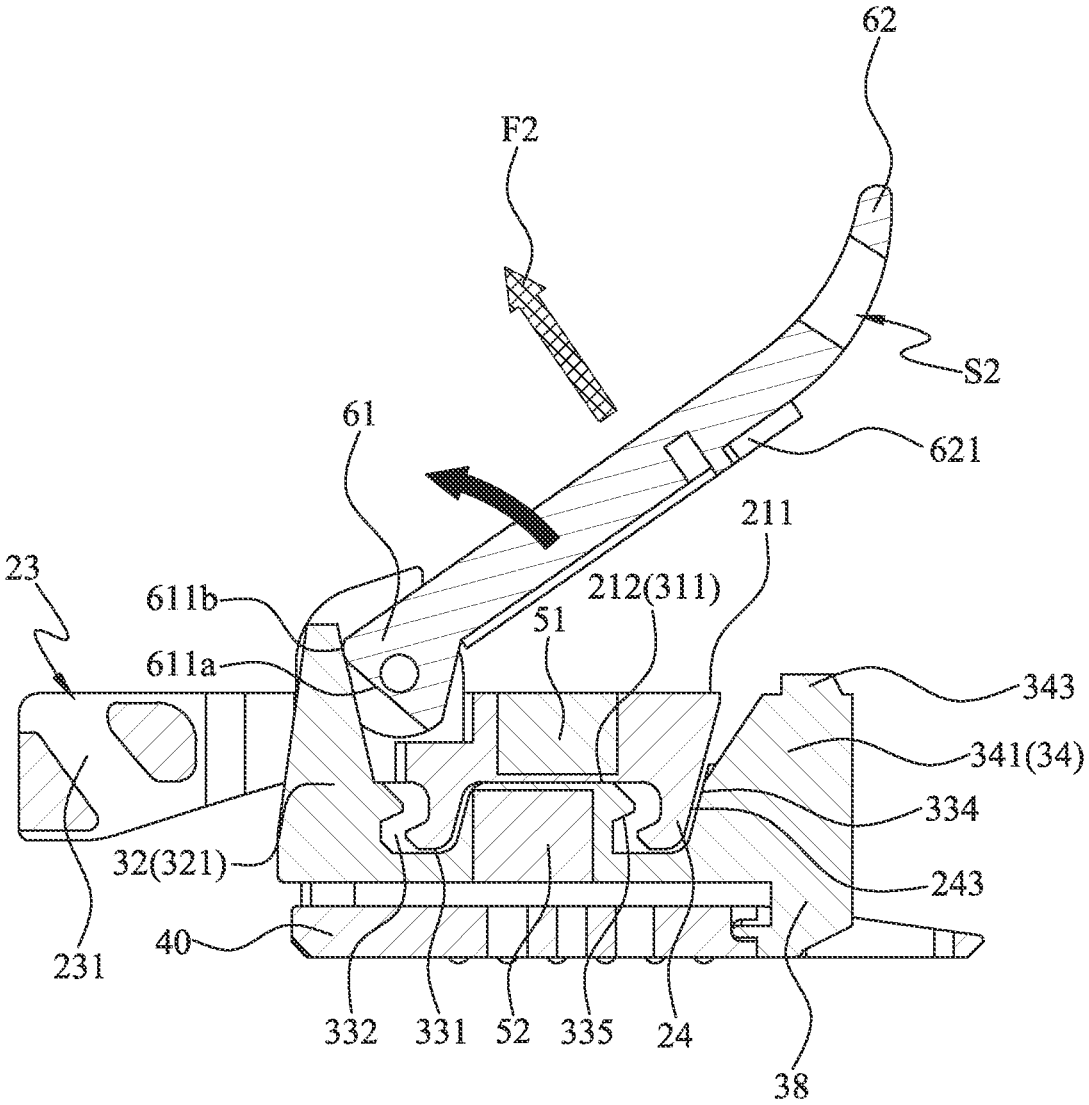
FIG. 9A is a sectional view showing the control lever is pivotally swung relative to the male member from an initial position to an actuating position.

Please refer to FIG. 9A. When a swing force F2 larger than the reset force F1 is applied to the control lever 60 for the latter to swing in a direction indicated by the bold black arrow, the control lever 60 would be moved away from the initial position S1 and the locating protrusion 343 of the auxiliary guide section 34 would be separated from the locating space 621 of the control lever 60. At this point, the surface of the actuating cam 61 in contact with the cambered surface 322 shifts from the reset surface 611*a* of the actuating contour 611 to the push surface 611*b* of the actuating cam 61. Meanwhile, the lever portion 62 of the control lever 60 gradually moves toward the male limiting protrusion 223 of the connecting section 22. When the lever portion 62 is in contact with the male limiting protrusion 223, the control lever 60 is stopped from swinging further and stays at an actuating position S2. Therefore, the male limiting protrusion 223 is able to limit a swing angle of the control lever 60. When there is not any swing force F2 applied to the control lever 60, the control lever 60 is remained to the initial position S1 under the reset force F1 with the locating protrusion 343 extended into the locating space 621. Therefore, the male member 20 is remained to the engaged position P4 and the retaining protrusions 242 of the male engaging section 24 are kept setting in the retaining spaces 332 of the female engaging section 33.

In the first preferred embodiment, the swing angle for the control lever 60 to swing to the actuating position S2 is larger than a slant angle of the second female guide-out surfaces 335. And, in the course the control lever 60 is swung from the initial position S1 to the actuating position S2, different surfaces of the actuating cam 61 of the control lever 60 are caused to push against the guide post 321 of the guide section 32, such that the male member 20 is moved rightward relative to the female member 30 along the third assembling path R3 (see FIG. 8D), which brings the retaining protrusions 242 of the male engaging section 24 to be moved from the engaged position P4 to the loose contact position P3, causing the retaining protrusions 242 to move out of the retaining spaces 332 of the female engaging section 33 into the engaging spaces 331 of the female engaging section 33. At this point, the entire male engaging section 24, including the extended portions 241 and the retaining protrusions 242, is located in the engaging spaces 331.

Figure 9B:
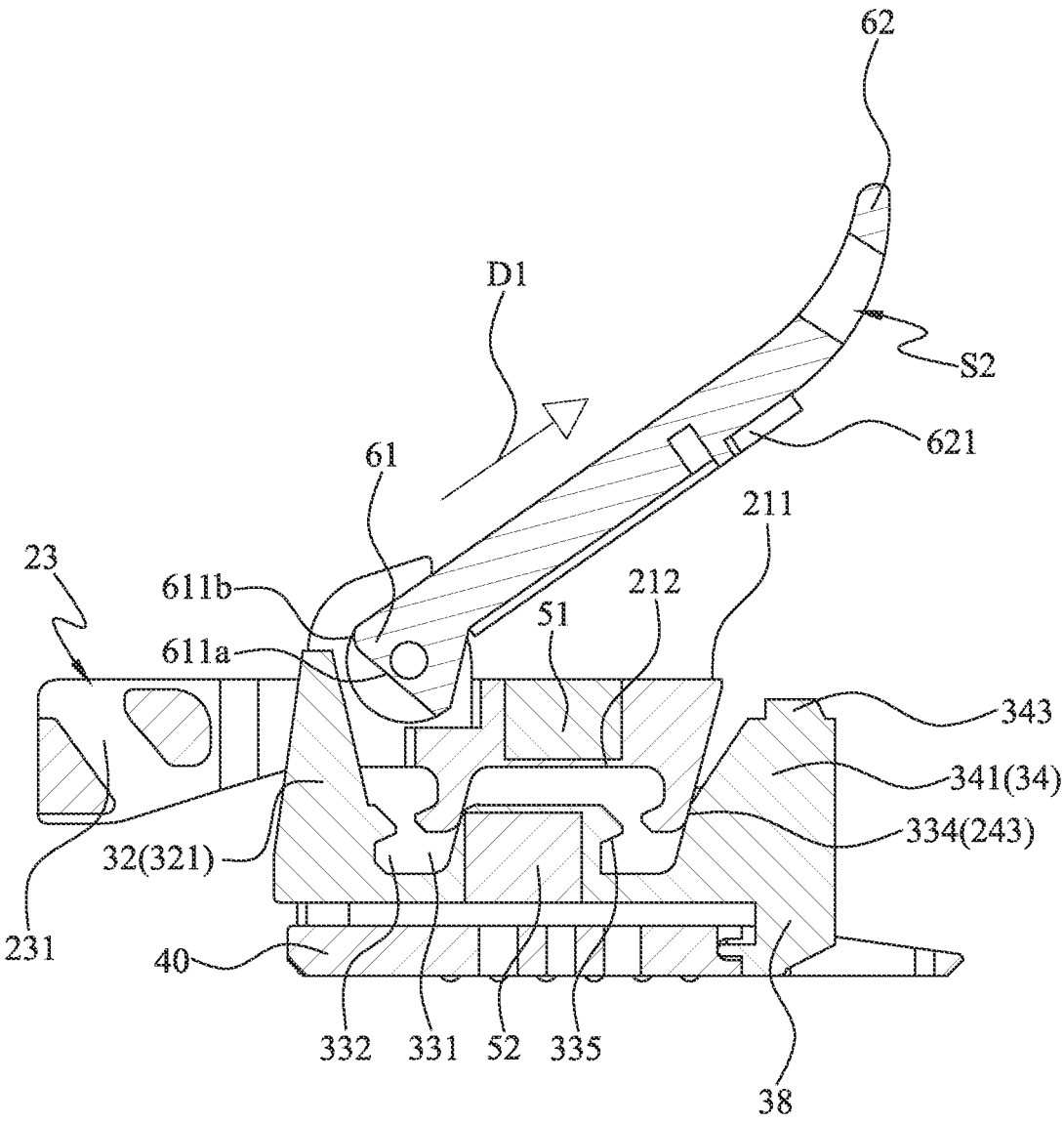
FIG. 9B shows first male guide-out surfaces of the male member are in contact with first female guide-out surface of the female member.
Figure 9C:
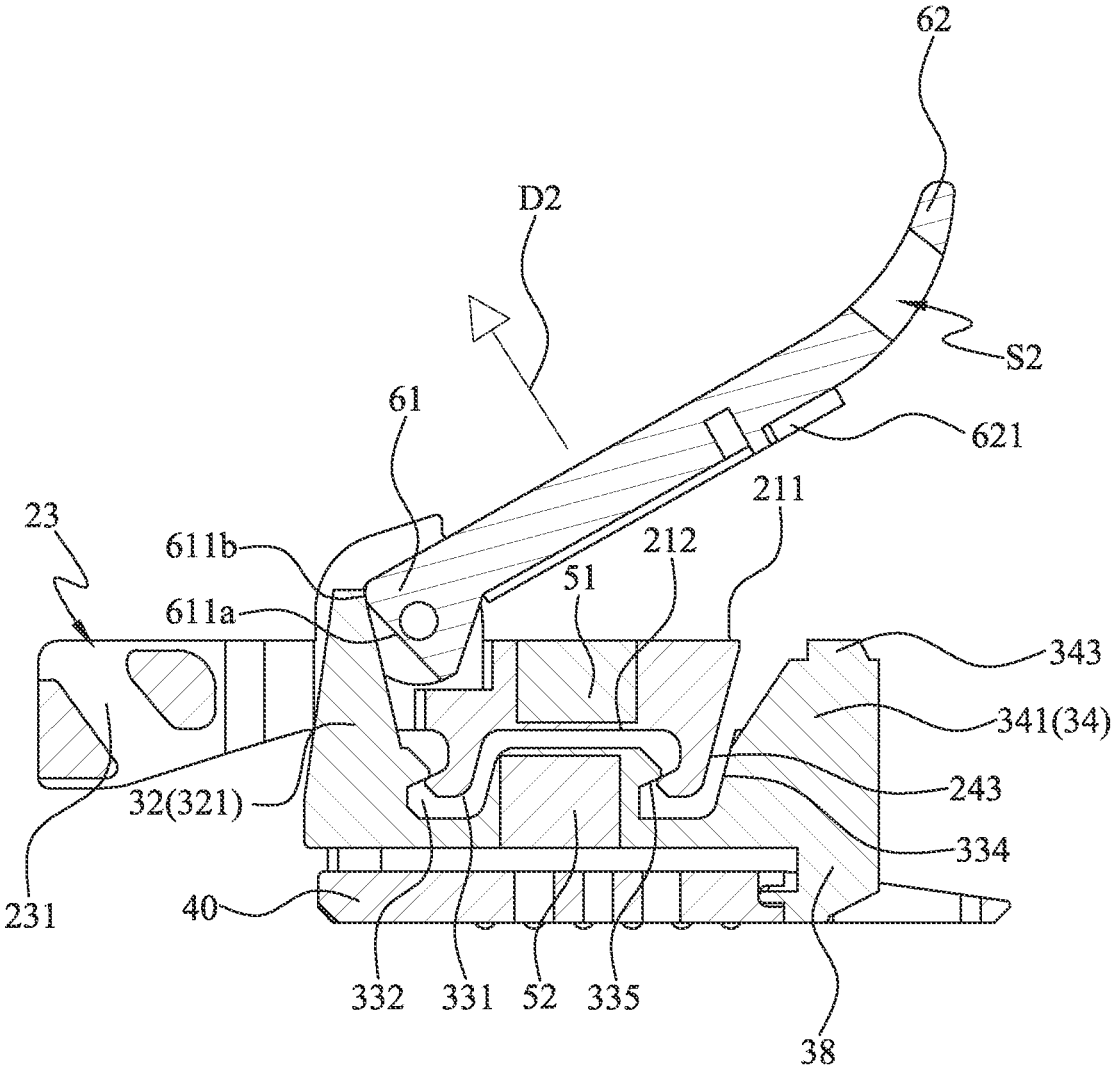
FIG. 9C shows second male guide-out surfaces of the male member are in contact with second female guide-out surface of the female member.

Please refer to FIG. 9B. When the control lever 60 is in the actuating position S2 (see FIG. 9A), the male member 20 is located at the loose contact position P3 (see FIG. 8C) with the extended portions 241 and the retaining protrusions 242 of the male engaging section 24 located in the engaging spaces 321 of the female engaging section 33. When a user pulls the control lever 60 at this point, the control lever 60 under the pull force can bring the male member 20 to move along a first separating path D1, which is slant relative to the X axis and the Z axis, causing the first male guide-out surfaces 243 of the male engaging section 24 to contact with the first female guide-in surfaces 334 of the female engaging section 33. At this point, the retaining protrusions 242 of the male engaging section 24 can be moved from the engaging spaces 331 of the female engaging section 33 to the surrounded space 37 of the female member 30, and the male member 20 can be oriented to the right side of the female member 30 and be released from the female member 30. However, it is noted the description of releasing the male member 20 from the female member 30 from the right side of the female member 30 is only illustrative. As shown in FIG. 9C, the user may pull the control lever 60 in a different direction for the control lever 60 under the externally applied force to move the male member 20 along a second separating path D2 that has a direction different from the first separating path D1, such that the second male guide-out surfaces 244 (see FIG. 4B) of the male engaging section 24 are brought to contact with the second female guide-out surfaces 335 of the female engaging section 33. At this point, the retaining protrusions 242 of the male engaging section 24 can be moved from the engaging spaces 331 of the female engaging section 33 into the surrounded space 37 of the female member 30, and the male member 20 can be oriented to the left side of the female member 30 and be released from the female member 30.

Figure 10:
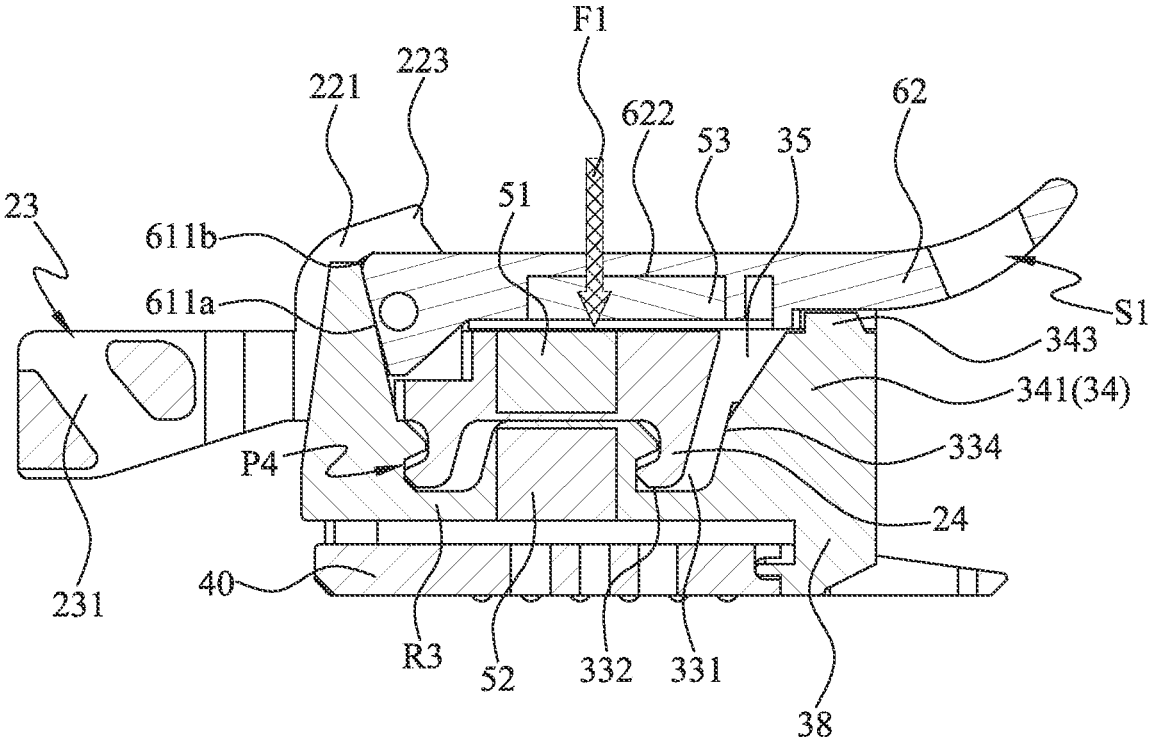
FIG. 10 is a sectional view of the lever-controllable magnetic buckle according to a second preferred embodiment of the present invention.

Please refer to FIG. 10, in which a second preferred embodiment of the present invention is shown. The second preferred embodiment is different from the first one in that the control lever 60 thereof is made of a plastic material and that a lower side of the lever portion 62 of the control lever 60 is upward recessed to form a control lever-side receiving space 622 located to the left side of the locating space 621 of the control lever 60. Meanwhile, the magnetic unit 50 further includes a reset magnetic element 53 set in the control lever-side receiving space 622 for magnetically attracting the male-side magnetic element 51 and generating the reset force F1 between the reset magnetic element 53 and the male-side magnetic element 51.

Figure 11:
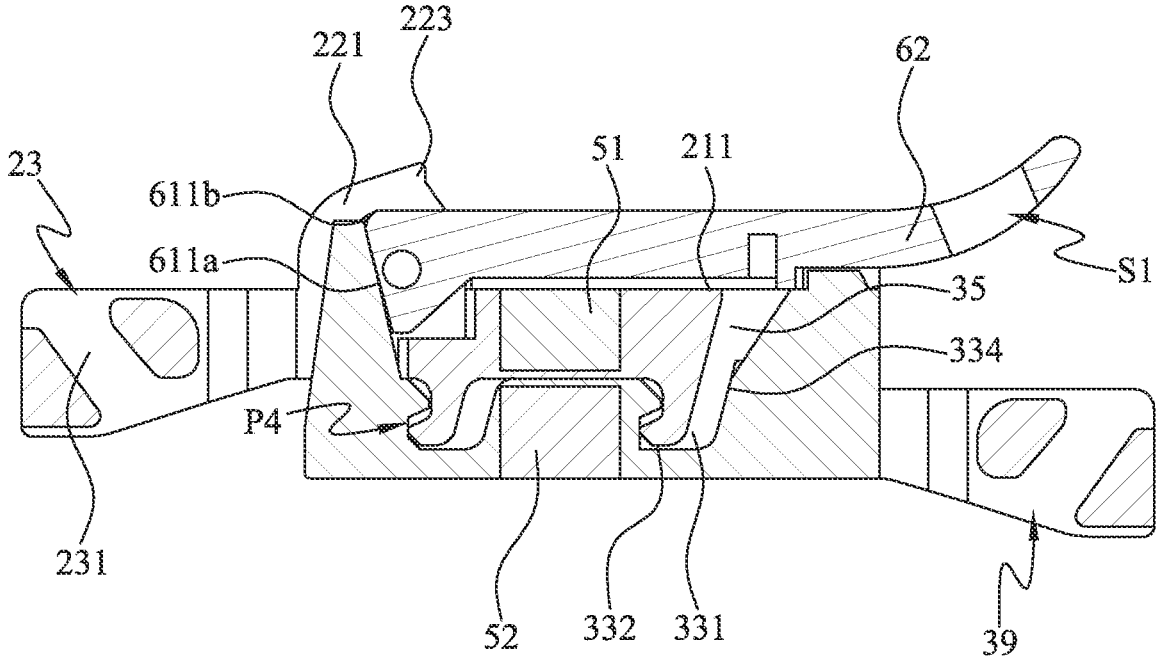
FIG. 11 is a sectional view of the lever-controllable magnetic buckle according to a third preferred embodiment of the present invention.

Please refer to FIG. 11, in which a third preferred embodiment of the present invention is shown. The third preferred embodiment is different from the first one in that the lever-controllable magnetic buckle 2 includes the male member 20, the female member 30, the magnetic unit 50 and the control lever 60 without the base plate 40, and that the female member 30 further includes a female-side protruded section 39, which is extended from the female buckling body 31 for another belt 71 to extending therethrough and accordingly, assembling the female member 30 to the object 70.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A lever-controllable magnetic buckle, comprising:

a male member including a male engaging section and a connecting section, and a male-side magnetic element is mounted in the male member;

a female member including a female engaging section and a guide section, and a female-side magnetic element is mounted in the female member; the female engaging section being formed at different locations with a female guide-in surface, a first female guide-out surface and a second female guide-out surface; and the male-side magnetic element is magnetically attracted for moving to the female-side magnetic element;

so that the male engaging section is engaged with the female engaging section after the male engaging section contacts with the female guide-in surface;

a control lever being pivotally connected to the connecting section and having an actuating cam for contacting with the guide section; the control lever is capable of swinging relatively with the male member so a surface of the actuating cam is pushed by the guide section, and the male engaging section is movable relative to the female member to separate from the female engaging section;

and when the male engaging section is separated from the female engaging section, the male member is capable of moving relatively with the female member along different directions; the male member will be separated from the female member after the male engaging section is selectively contacted with one of the first female guide-out surface and the second female guide-out surface.

2. The lever-controllable magnetic buckle as claimed in claim 1, wherein the connecting section includes a male limiting protrusion, and the control lever is selectively swingable to contact with or separate from the male limiting protrusion; and the control lever is stopped by the male limiting protrusion when the control lever is in contact with the male limiting protrusion, so the swing angle of the control lever is limited by the male limiting protrusion.

3. The lever-controllable magnetic buckle as claimed in claim 2, wherein the swing angle of the control lever is larger than a slant angle of the second female guide-out surface.

4. The lever-controllable magnetic buckle as claimed in claim 1, wherein the connecting section includes two connecting blocks spaced from each other, and both the actuating cam and the guide section being located between the two connecting blocks, such that the two connecting blocks and the actuating cam are located around the guide section so as the guide section is located among the control lever and the two connecting blocks for limiting the male member from moving horizontally relative to the female member.

5. The lever-controllable magnetic buckle as claimed in claim 1, wherein the female member includes an auxiliary guide section spaced from the guide section, such that a surrounded space is formed between the guide section and the auxiliary guide section at one side of the female-side magnetic element; and the surrounded space being used to receive part of the male member.

6. The lever-controllable magnetic buckle as claimed in claim 5, wherein the guide section has a cambered surface formed facing toward the surrounded space, and the actuating cam has a reset surface and a push surface located adjacent to the reset surface; the reset surface remaining in contact with the cambered surface when the male-side magnetic element is magnetically attracted for moving to the female-side magnetic element, such that the male engaging section remains engaging with the female engaging section; and the push surface in contact with the cambered surface allowing the male member to move relative to the female member.

7. The lever-controllable magnetic buckle as claimed in claim 6, wherein the guide section further has a slant guide surface formed on one side adjacent to the cambered surface, such that the guide surface is located between the cambered surface and female guide-in surface; and the guide surface being contactable with the male member to guide part of the male member into the surrounded space.

8. The lever-controllable magnetic buckle as claimed in claim 5, wherein a locating protrusion is upwardly formed at the top of the auxiliary guide section and a locating space is formed at the bottom of the control lever; the locating protrusion being extended into the locating space, such that the control lever is limited from moving horizontally by cooperation of the locating protrusion and the locating space.

9. The lever-controllable magnetic buckle as claimed in claim 8, wherein the auxiliary guide section further includes an auxiliary guide surface facing toward the surrounded space, such that the auxiliary guide surface is located between the locating protrusion and the first female guide-out surface; and the auxiliary guide surface being contactable with the male member to guide part of the male member into the surrounded space.

10. The lever-controllable magnetic buckle as claimed in claim 5, wherein the female member further includes a first limiting section and a second limiting section; the guide section, the female engaging section and the auxiliary guide section being sequentially arranged in an x-axis direction; and the first limiting section, the female engaging section and the second limiting section being sequentially arranged in a y-axis direction.

11. The lever-controllable magnetic buckle as claimed in claim 1, wherein the female engaging section has engaging spaces downward recessed in a z-axis direction and a retaining space sidewardly recessed in an x-axis direction; the engaging spaces respectively having an open end and a closed end located opposite to the open end, and the female guide-in surface being located adjacent to the open ends while the first female guide-out surface being formed from the open ends to the closed ends.

12. The lever-controllable magnetic buckle as claimed in claim 11, wherein the female guide-in surface and the first female guide-out surface are located at two opposite sides of the engaging spaces in the x-axis direction, and the second female guide-out surface are vertically located below the female guide-in surface.

13. The lever-controllable magnetic buckle as claimed in claim 1, wherein the male engaging section includes an extended portion downward extended in a z-axis direction and a retaining protrusion sideward extended from the extended portion in an x-axis direction; the extended portion having a first male guide-out surface contactable with the first female guide-out surface, and the retaining protrusion having a second male guide-out surface contactable with the second female guide-out surface, and a male guide-in surface contactable with the female guide-in surface; the second male guide-out surface and the male guide-in surface being located at two opposite sides of the retaining protrusions in a z-axis direction, and the first male guide-out surface being located at a lateral side of the male guide-in surface.

14. The lever-controllable magnetic buckle as claimed in claim 1, wherein the male-side magnetic element mounted to the male member generates a reset force that brings the control lever to move toward the male member, such that the control lever remains in contact with the male member under the reset force.

* * * * *